US006985688B2

(12) United States Patent
Ishizuka et al.

(10) Patent No.: US 6,985,688 B2
(45) Date of Patent: Jan. 10, 2006

(54) IMAGE FORMING PROCESS AND IMAGE FORMING APPARATUS, ELECTROPHOTOGRAPHIC IMAGE-RECEIVING SHEET, AND ELECTROPHOTOGRAPHIC PRINT

(75) Inventors: Hiroshi Ishizuka, Kanagawa (JP); Ashita Murai, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 202 days.

(21) Appl. No.: 10/700,768

(22) Filed: Nov. 5, 2003

(65) Prior Publication Data

US 2004/0091296 A1 May 13, 2004

(30) Foreign Application Priority Data

Nov. 7, 2002 (JP) ..... 2002-324441

(51) Int. Cl.
*G03G 15/20* (2006.01)

(52) U.S. Cl. ..... 399/329

(58) Field of Classification Search ..... 399/328, 399/329, 341; 219/469–471, 216
See application file for complete search history.

(56) References Cited

U.S. PATENT DOCUMENTS 5,099,288 A * 3/1992 Britto et al. ..... 219/216
6,537,741 B2 * 3/2003 Chen et al. ..... 399/329
6,567,640 B2 * 5/2003 Ishikawa et al. ..... 399/329
6,618,573 B2 * 9/2003 Ishikawa et al. ..... 399/328
6,623,897 B2 * 9/2003 Tomita ..... 399/328
2001/0006583 A1 7/2001 Tomita
2002/0057934 A1 5/2002 Ishikawa et al.
2003/0035666 A1 * 2/2003 Ishikawa et al. ..... 399/329

FOREIGN PATENT DOCUMENTS

JP 2002-23406 A 1/2002
JP 2002-91048 A 3/2002

* cited by examiner

*Primary Examiner*—Susan Lee
(74) *Attorney, Agent, or Firm*—Sughrue Mion, PLLC

(57) ABSTRACT

To provide an electrophotographic method and apparatus for forming images stably having a good, agreeable, and natural texture in gloss equivalent to conventional silver halide photographic prints, an electrophotographic image-receiving sheet for use in the formation of such images and such an electrophotographic print, an image forming process produces an electrophotographic print by fixing a toner image on an electrophotographic image-receiving sheet using a belt fixing device of cooling and separating system. In the electrophotographic print, a specular glossiness GsP (45°) and a reflected light scattering index GsP(*45±3°) of a black print image on the toner image-bearing surface of the electrophotographic print satisfy specific conditions.

24 Claims, 6 Drawing Sheets

IMAGE FORMING PROCESS AND IMAGE FORMING APPARATUS, ELECTROPHOTOGRAPHIC IMAGE-RECEIVING SHEET, AND ELECTROPHOTOGRAPHIC PRINT

BACKGROUND OF THE INVENTION

1. Field of the Invention

The present invention relates to a process and apparatus for forming images having a "texture in gloss" equivalent to silver halide photographic prints by suppressing scattering of reflected light corresponding to, for example, sharpness of glare or reflection of light source, and to electrophotographic image-receiving sheets for use in the formation of such images, and to the resulting electrophotographic prints.

2. Description of the Related Art

The gloss of a reflective print is generally represented by a specular glossiness (hereinafter may be briefly referred to as "glossiness") specified, for example, in Japanese Industrial Standards (JIS) Z 8741 and P 8142. Commercially available silver halide photographic prints have a 45° glossiness determined according to JIS Z 8741 of generally about 90. As a possible solution to improve the glossiness of electrophotographic prints to those of silver halide photographic prints, Japanese Patent Application Laid-Open (JP-A) Nos. 08-212168 and 2001-183860 each disclose an electrophotographic image-receiving sheet having a support and a toner image-receiving layer containing a thermoplastic resin on the support.

JP-A No. 2002-23406 proposes the improvement of an electrophotographic image-receiving sheet having a toner image-receiving layer, in which the sheet has a glossiness of a certain level or more and shows suppressed scattering of reflected light, to thereby improve the texture in gloss of the resulting electrophotographic print.

JP-A No. 2002-91048 proposes a belt fixing method for improving the gloss using a printer, in which a smooth surface of a fixing belt is pressed to the surface of a print image in image fixing by heating and pressuring to thereby yield a good gloss of the print.

These conventional means are effective for improving the specular glossiness specified in JIS, a part of which can yield a specular glossiness equivalent to silver halide photographic prints. However, such electrophotographic prints still often give a texture in gloss different from that of silver halide photographic prints even they have a specular glossiness equivalent thereto. For example, they may give unpleased textures such as glare, rough or dry texture.

These conventional technologies cannot provide electrophotographic prints stably having a good, agreeable, and natural texture in gloss equivalent to silver halide photographic prints and having sufficiently satisfactory properties. Further improvements on this point have been demanded.

Accordingly, an object of the present invention is to provide an electrophotographic process and apparatus for forming images stably having a good, agreeable, and natural texture in gloss equivalent to conventional silver halide photographic prints, to provide an electrophotographic image-receiving sheet for use in the formation of such images, and to provide such an electrophotographic print.

SUMMARY OF THE INVENTION

The inventors of the present invention discussed intensively, resulting in the following findings.

Specifically, an electrophotographic print having an excellent texture in gloss can be produced by an electrophotographic image forming process, in which a specific electrophotographic image-receiving sheet having at least one toner image-receiving layer on a support and a specific belt fixing method employing cooling separation using a fixing belt are used, and indexes specified by the relation between the specular glossiness and the reflected light scattering index in an image area of the electrophotographic print are set within specific ranges.

After intensive investigations on the posture and behavior of observers of an electrophotographic print when they evaluate whether the glossiness of the electrophotographic print is desirable or not, the present inventors have found that the observers observe the electrophotographic print from different angles and look an observation light source reflected on the print, and that they decide whether the print has a good glossiness or not based on that the observation light source is reflected sharply or not. In other words, the glossiness of an electrophotographic print is determined based on (1) whether the reflected light on the print is intense or feeble, as well as (2) whether it is sharp or blurred due to a large quantity of scattered light. However, the conventional specular glossiness measurements reflect (1) the reflected light is intense or feeble but do not specifically relate to (2) whether the reflected light is sharp or blurred due to a large quantity of scattered light.

To yield satisfactory "texture in gloss" of an electrophotographic print, it is essential to suppress scattering of reflected light corresponding to the sharpness of the reflection of a light source, as well as to increase the conventional specular glossiness of the electrophotographic print. These advantageous properties can be exhibited more by using an electrophotographic image-receiving sheet having a polyolefin resin coated layer formed by lamination as a support, specifying the surface roughness of a fixing belt at a certain level or less, and specifying the thickness of a toner image-receiving layer at a certain level or more. The present invention has been accomplished based on these findings.

Accordingly, the present invention provides an image forming process and apparatus which form a toner image on electrophotographic image-receiving sheet having a support and at least one toner image-receiving layer on the support; and fix the toner image on the electrophotographic image-receiving sheet using a belt fixing device to thereby produce an electrophotographic print image. In the fixing, a fixing belt of the belt fixing device is rotatably supported by plural supporting members including a heating member; a pressure rotator is pressed to the heating member with the interposition of the fixing belt to form a nip; the electrophotographic image-receiving sheet bearing the toner image is allowed to pass through the nip to fix and cool the toner image on the electrophotographic image-receiving sheet; and the electrophotographic image-receiving sheet is released from the fixing belt. In the method and apparatus, a specular glossiness GsP(45°) and a reflected light scattering index GsP(*45±3°) of a black print image on the toner image-bearing surface of the electrophotographic print satisfy the following conditions (I), (II) and (III):

$$30 \leqq GsP(45°) \quad \text{(I):}$$

$$0 \leqq GsP(*45 \pm 3°) \leqq 15 \quad \text{(II):}$$

$$[GsP(45°)/GsP(*45 \pm 3°)] \geqq 6 \quad \text{(III):}$$

wherein GsP(45°) is a specular glossiness at an incident angle of 45° and an acceptance angle of 45°; and GsP (*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°. The resulting electrophotographic print can stably have an agreeable, natural, and good texture in gloss equivalent to conventional silver halide photographic prints.

The present invention further provides an electrophotographic print, in which a specular glossiness GsP(45°) and a reflected light scattering index GsP(*45±3°) of a black print image on the toner image-bearing surface of the electrophotographic print satisfy the following conditions (I), (II) and (III):

$$30 \leqq GsP(45') \quad \text{(I):}$$

$$0 \leqq GsP*45\pm3^\circ) \leqq 15 \quad \text{(II):}$$

$$[GsP(45^\circ)/GsP(*45\pm3^\circ)] \geqq 6 \quad \text{(III):}$$

wherein GsP(45°) is a specular glossiness at an incident angle of 45° and an acceptance angle of 45°; and GsP (*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

DESCRIPTION OF THE PREFERRED EMBODIMENTS

Figure 1:
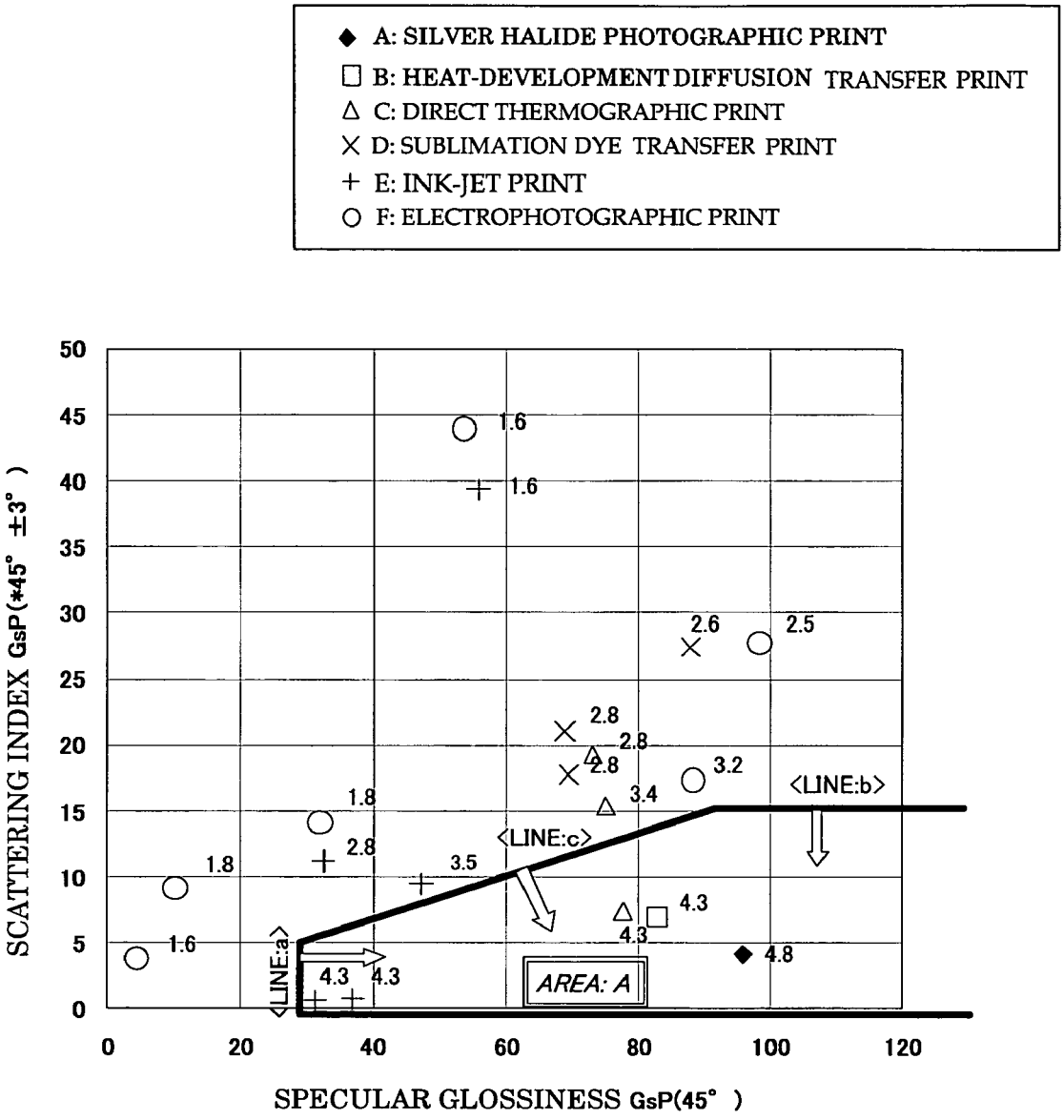
FIG. 1 is a graph showing the relation between a specular glossiness GsP(45°) and a reflected light scattering index GsP(*45±3°).

Image Forming Process and Image Forming Apparatus

The image forming process of the present invention fixes a toner on an electrophotographic image-receiving sheet using a belt fixing device having a heating and pressuring member, a fixing belt, a cooling device, and a cooling-releasing section.

The image forming apparatus of the present invention is so configured as to fix a toner on an electrophotographic image-receiving sheet using a belt fixing device having a heating and pressuring member, a fixing belt, a cooling device, and a cooling-releasing section.

In the image forming process and apparatus, a specular glossiness GsP(45°) and a reflected light scattering index GsP (*45±3°) of a black print image on the toner image-bearing surface of the resulting electrophotographic print satisfy specific conditions on gloss, which electrophotographic print is produced by fixing a toner on an electrophotographic image-receiving sheet using a belt fixing device employing cooling separation.

In the electrophotographic image forming process, a specular glossiness GsP(45°) and a reflected light scattering index GsP(*45±3°) of a black print image on the toner image-bearing surface of the electrophotographic print satisfy the following conditions (I), (II) and (III):

$$30 \leqq GsP(45^\circ) \quad \text{(I):}$$

$$0 \leqq GsP(*45\pm3^\circ) \leqq 15 \quad \text{(II):}$$

$$[GsP(45^\circ)/GsP(*45\pm3^\circ)] \geqq 6 \quad \text{(III):}$$

wherein GsP(45°) is a specular glossiness at an incident angle of 45° and an acceptance angle of 45°; and GsP (*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

The specular glossiness GsP(45°) specified in Condition (I) should be 30 or more and is preferably 60 or more, and more preferably 75 or more.

The reflected light scattering index (herein may be briefly referred to as "scattering index") GsP(*45°±3°) specified in Condition (II) should be 0 or more and 15 or less, is preferably 0 or more and 10 or less, and more preferably 0 or more and 6 or less.

The ratio [GsP(45°)/GsP(*45°±3°)] specified in Condition (III) should be 6 or more, is preferably 8 or more and more preferably 15 or more.

If the specular glossiness GsP(45°) and the scattering index GsP(*45°±3°) do not satisfy at least one of Conditions (I), (II), and (III), the resulting print has an undesirable texture in gloss, such as glare, dull or blur texture.

The specular glossiness GsP(45°) and the scattering index GsP(*45°±3°) can be determined by using a specular glossmeter according to JIS Z 8741, such as a glossmeter UGV-6P (trade name, available from Suga Test Instruments, Japan).

The specular glossiness is specified in JIS so as to be measured at an incident angle equal to a reflected angle (i.e., acceptance angle), which determines the intensity of directly reflected light. The 45° specular glossiness determined according to the conventional method of JIS Z 8741 is defined herein as an index of the intensity of directly reflected light GsP(45°).

The scattering index GsP(*45°±3°) is not specified in JIS Z 8741 but can be determined by calibrating under measurement conditions for the 45° specular glossiness at an incident angle of 45° and an acceptance angle of 45° as specified in JIS Z 8741 and changing the acceptance angle alone to 42° or 48°. The scattering index GsP(*45°±3°) used herein is the average of measured glossiness at acceptance angles of 42° and 48°.

Conditions (I) and (II) will be described in further detail below. Several prints of a uniform black image were produced using different apparatus or materials as silver halide photographic prints (A; one type), heat-development diffusion-transfer prints (B, one type), direct thermographic prints (C; three types), sublimation dye transfer prints (D; three types), ink-jet prints (E; five types), and conventional electrophotographic prints (F; six types). The specular glossiness GsP(45°) and the scattering index GsP(*45°±3°) of the above-prepared prints were determined, the prints were subjected to a sensory test with ten observers and were scored in five levels according to the following criteria.

[Criteria]

5: Very desirable
4: Desirable
3: Medium
2: Undesirable
1: Very undesirable

The results are shown in FIG. 1 with the ordinate showing the scattering index GsP(*45°±3°) and the abscissa showing the specular glossiness GsP(45°). Average values of the scores of 10 observers are shown in the figure. FIG. 1 shows that a group of prints which the observers assessed to have desirable glossiness center on a specific area. Area A in FIG. 1 is an area in which prints are assessed highly with an average score of 4 (Desirable) or higher and have good gloss.

FIG. 1 clearly shows that the following three requirements are important for the observers to assess that the print has good glossiness:

(i) The specular glossiness GsP(45°) should be at a specific level or higher (the right hand of the line "a" in FIG. 1).
(ii) The scattering index GsP(*45°±3°) should be at a specific level or less (below the line "b" in FIG. 1).
(iii) The ratio [GsP(45°)/GsP(*45°±3°)] of the specular glossiness GsP(45°) to the scattering index GsP(*45°±3°) should be at a specific level or more (below the line "c" in FIG. 1).

The results show that the observers intensively respond to not only the intensity of the directly reflected light (corresponding to the requirement (i)) but also to the absolute value of the weakness of the scattered light (corresponding to the requirement (ii)) and to the ratio of the specular glossiness GsP(45°) to the scattering index GsP(*45°±3°) (corresponding to the requirement (iii)). The present inventors have found that prints are not assessed to have good texture in gloss unless these three requirements are satisfied. In particular, they have found that the ratio of GsP(45°) to GsP(*45°±3°) (the requirement (iii)) significantly affects the texture in gloss of the prints.

This means that, for example, when an observer observes a print under illumination of two parallel fluorescent lamps, the image of the fluorescent lamps is clearly seen on the print (corresponding to the requirement (i)), blur caused by scattering is little (corresponding to the requirement (ii)), and the individual fluorescent lamps can be observed clearly separately (corresponding to the requirement (iii)).

The scattering index GsP(*45°±3°) is the average of measurements at 42° and 48° corresponding to the tails of the profile and represents an absolute value of the intensity of the scattered light out of direct reflection (specular reflection). The ratio of GsP(45°) to GsP(*45°±3°) represents the sharpness of the profile based on the relation between the directly reflected light and the scattered light.

Condition (III) will be described in further detail below. The profiles of measured reflected light at different acceptance angles are shown on typical four prints A-1 (silver halide photographic print), E-1 (ink-jet print), E-2 (ink-jet print) and F-6 (conventional electrophotographic print). Each of these profiles is in a substantially bilaterally symmetric bell form with the maximum at 45°.

Figure 2:
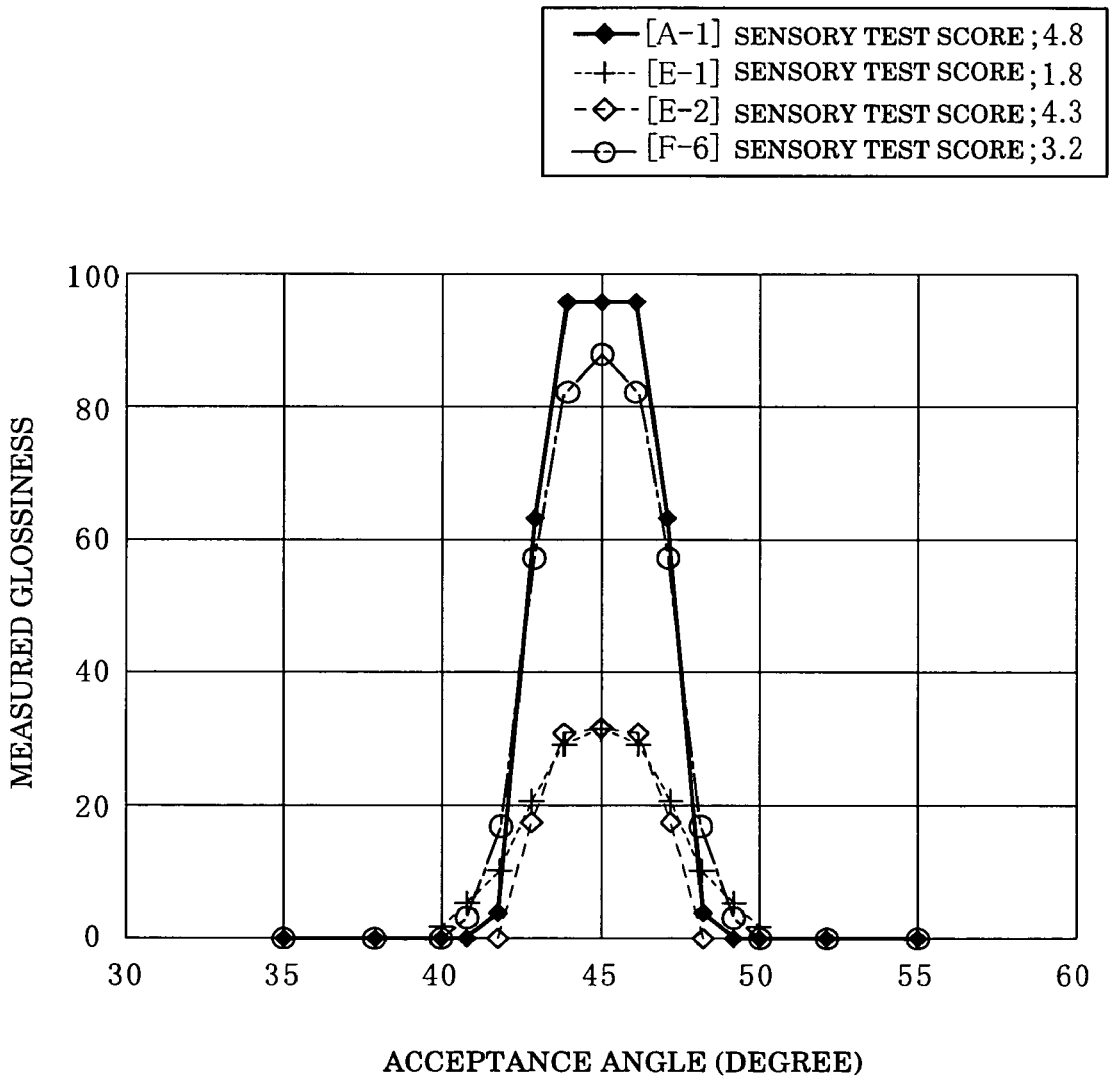
FIG. 2 is a graph showing the relation between an acceptance angle and a measured glossiness.

In FIG. 2, the measurement at an acceptance angle of 45° is the specular glossiness GsP(45°) specified in JIS Z 8741, and the average of measurements at 42° and 48° corresponding to the tails of the bell-like profiles is the scattering index GsP(*45°±3°) specified in the present invention.

The prints A-1 and F-6 or E-1 and E-2 each have a similar specular glossiness GsP(45°) but have different gloss which the observer feels. Specifically, the prints A-1 and E-2 are rated to have good gloss. Focussing attention to the tails of the profiles at 42° and 48°, i.e., the scattering index GsP (*45°±3°), the prints A-1 and E-2 rated to have good gloss have a decreased scattering index and have a sharp profile with less tails. These show that a sharp profile is an important factor for desirable gloss.

Figure 3:
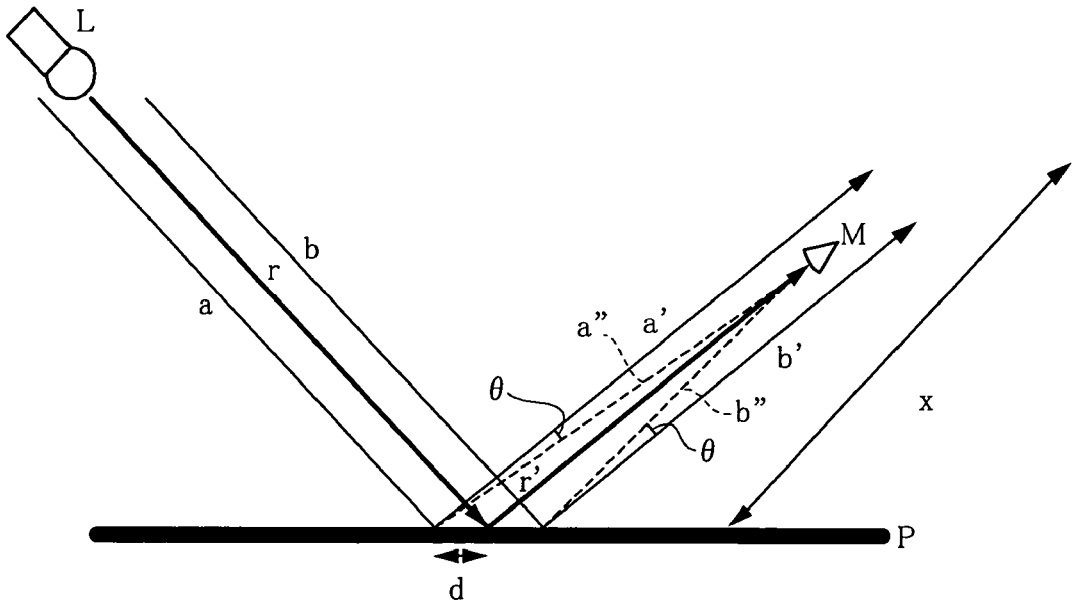
FIG. 3 is a schematic view showing the positions of a light source L, a sample print P, and an observer M.

FIG. 3 is a schematic view of the relation among a light source L, a sample print P, and an observer M. In FIG. 3, the distance x (observation distance) between the sample print and the observer is assumed to be ordinary distance, 30 cm and the light source is assumed to be sufficiently far from the print. Upon the observation of the light source image reflected on the print, the observer detects scattered light a" and b" in addition to directly reflected light r'. In this case, the observer sees a focused blur image at a position d from the regular reflection point of the light source. Namely, the intensity of reflected light (scattered light) at an angle θ shifted from the direct reflection means the intensity of blur at a position d shifted from the regular position of the reflection of the light source.

The relation between the scattering angle θ and the blur width d is shown below by Formula (VII):

$$d = x \cdot \sin\theta / \sin(45-\theta) \quad \text{(VII):}$$

When the scattering angle θ is 3°, the blur width d is determined by calculation as 2.3 cm, corresponding to a blur width at which the observer determines that the reflection of an actual sample is blurred or dull.

As is described above, the present invention provides a printed image having a good texture in gloss by combination use of a specific electrophotographic image-receiving sheet having a toner image-receiving layer, a specific image-fixing method using a fixing belt, and an electrophotographic process. However, the present invention does not always requires that the electrophotographic image-receiving sheet before printing has high gloss and smoothness.

Excessively high gloss and smoothness of the electrophotographic image-receiving sheet before printing may invite problems such as imperfect conveying of the electrophotographic image-receiving sheet due to slippage between the sheet and a conveying member or shift in toner dot images. Viewing this, the electrophotographic image-receiving sheet before printing may preferably have somewhat low glossiness and smoothness for better stability in printing. Accordingly, it is preferred that a toner image-forming surface of the electrophotographic image-receiving sheet before printing has a specular glossiness GsP(45°) and a reflected light scattering index GsP (*45±3°) satisfying at least one of the following conditions (IV), (V) and (VI):

$$\text{GsP}(45°) < 30 \quad \text{(IV):}$$

$$\text{GsP}(*45\pm3°) > 15 \quad \text{(V):}$$

$$1 \leqq [\text{GsP}(45°)/\text{GsP}(*45\pm3°)] < 6 \quad \text{(VI):}$$

wherein GsP(45°) and GsP(*45±3°) have the same meanings as defined above.

Even in this case, the resulting print produced by the method of the present invention has good gloss.

The electrophotographic image-receiving sheet has at least one toner image-receiving layer on a support. The support preferably comprises a base and at least one thermoplastic resin layer on the base for better production of an electrophotographic print as a result of image-fixing. The details of the electrophotographic image-receiving sheet will be described later.

The electrophotographic process for use in the electrophotographic image forming process of the present invention produces a print image by forming a toner image on electrophotographic image-receiving sheet having a support and at least one toner image-receiving layer on the support; and fixing the toner image on the electrophotographic image-receiving sheet using a belt fixing device. In the fixing, a fixing belt of the belt fixing device is rotatably supported by plural supporting members including a heating member; a pressure rotator is pressed to the heating member with the interposition of the fixing belt to form a nip; the electrophotographic image-receiving sheet bearing the toner image is allowed to pass through the nip to fix and cool the toner image on the electrophotographic image-receiving sheet; and the electrophotographic image-receiving sheet is released from the fixing belt. By subjecting the electrophotographic image-receiving sheet to the electrophotographic process, a target electrophotographic print image having good gloss can be produced.

Electrophotographic Print

In the electrophotographic print of the present invention, a specular glossiness GsP(45°) and a reflected light scattering index GsP(*45±3°) of a black print image on its toner image-bearing surface satisfy the following conditions (I), (II) and (III):

$$30 \leqq GsP(45°) \quad \text{(I):}$$

$$0 \leqq GsP(*45 \pm 3°) \leqq 15 \quad \text{(II):}$$

$$[GsP(45°)/GsP(*45 \pm 3°)] \geqq 6 \quad \text{(III):}$$

wherein GsP(45°) is a specular glossiness at an incident angle of 45° and an acceptance angle of 45°; and GsP(*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

The electrophotographic print of the present invention can be printed out by any method, as long as Conditions (I), (II), and (III) are satisfied. For example, it can be printed out by the image forming process of the present invention but can also be printed out by any other image forming processes.

The electrophotographic print of the present invention has very high quality and has agreeable, natural and good texture in gloss equivalent to silver halide photographic prints.

In the electrophotographic image forming process of the present invention, a specular glossiness GsP(45°) and a reflected light scattering index GsP(*45±3°) of a black print image on the toner image-bearing surface of the electrophotographic print satisfy Conditions (I), (II) and (III). The electrophotographic image-receiving sheet, toner and the belt fixing and smoothing device for use herein will be illustrated in detail below.

<Electrophotographic Image-receiving Sheet>

The electrophotographic image-receiving sheet comprises a support and a toner image-receiving layer arranged on the support, which support comprises a base and a thermoplastic resin layer on at least one side of the base. If desired, it may further comprise any of additional layers such as interlayers, protection layers, undercoat layers, cushioning layers, charge control (anti-static) layers, reflective layers, color adjustment layers, storage stability improving layers, adhesion inhibiting layers, anti-curling layers, and smoothing layers. These layers may have a single-layer structure or a laminated structure.

-Base-

The base is not particularly limited, and it may suitably be selected according to the purpose, provided that it is resistant to fixing temperature and satisfies requirements in some aspects such as smoothness, whiteness, slidability, friction, electrification prevention, denting after fixing, and the like. In general, the examples of the base include photographic supports such as papers, synthetic polymers (films), and the like as described in pages 223–240 of *The Basics of Photographic Engineering: Silver halide Photography* by Society of Photographic Science and Technology of Japan (Corona Publishing Co., Ltd., 1979).

Specific examples of the base include paper supports such as synthetic paper (of polyolefin, polystyrene, and the like), free sheet, art paper, single- and double-side coated paper, single- and double-side cast coated paper, mixed paper which is made from synthetic resin (such as polyethylene and the like) pulp and natural pulp, Yankee paper, baryta-coated paper, wallpaper, backing paper, synthetic resin- or emulsion-impregnated paper, synthetic rubber latex-impregnated paper, synthetic resin-added paper, paper board, cellulose fiber paper, and the like; various plastic films or sheets such as polyolefin, polyvinyl chloride, polyethylene terephthalate, polystyrene methacrylate, polyethylene naphthalate, polycarbonate polyvinyl chloride, polystyrene, polypropylene, polyimide, celluloses (such as triacetyl cellulose), and the like; the same films and sheets which are additionally treated to obtain reflectivity of white color (for example, adding a pigment such as titanium oxide into the film); cloths; metals; glasses; and the like.

These may be used either alone, or in combination of two or more as a laminate.

Other examples of the base include those described in pages 29–31 of JP-A No. 62-253159, pages 14–17 of JP-A No. 01-61236, JP-A No. 63-316848, JP-A No. 02-22651, JP-A No. 03-56955, U.S. Pat. No. 5,001,033, and the like.

The base preferably has a high surface smoothness, and specifically, a surface roughness (Oken method smoothness) of the base is preferably 210 seconds or more, and more preferably 250 seconds or more.

If the surface roughness (Oken smoothness) is less than 210 seconds, an image quality of an image may be poor when the image is formed.

In the present invention, the Oken type smoothness refers to the smoothness specified by the JAPAN TAPPI No. 5 B method.

The thickness of the base is preferably 25 $\mu$m to 300 $\mu$m, more preferably 50 $\mu$m to 260 $\mu$m, and still more preferably 75 $\mu$m to 220 $\mu$m.

The stiffness of the base is not particularly limited, and it may suitably be selected according to the purpose, but it is preferable for an image-receiving paper of photographic image quality that the stiffness be close to that of a base for color silver halide photographs.

The density of the base is preferably 0.7 g/cm$^3$ or more from the viewpoint of fixing properties.

The thermal conductivity of the base is not particularly limited, and it may suitably be selected according to the purpose, but it is preferable, that the thermal conductivity be 0.50 kcal/m·h·°C. or more under the condition of 20° C. and 65% relative humidity, from the viewpoint of fixing properties.

In the present invention, thermal conductivity can be measured according to a method described in JP-A No. 53-66279 using a sheet of paper prepared according to JIS P 8111.

Various additives which are suitably selected according to the purpose may be added to the base provided that the additives do not hinder the effect of the present invention.

Examples of the additives include whitener; conductive agent; filler; pigments and dyes including, for example, titanium oxide, ultramarine blue, and carbon black; and the like.

One or both sides of the base may be given various surface treatments or priming treatments in order to improve adhesion to a layer, layers, or the like deposited on the base.

Examples of the surface treatments include embossing treatment for glossy surface, micro-structured surface described in JP-A No. 55-26507, matte surface, and silky surface; corona discharge treatment; flame treatment; glow discharge treatment; activation treatment such as, for example, plasma treatment; and the like.

Only one of these treatments may be carried out, or any of these treatments may be used in combination; for example, the activation treatment may be carried out after the embossing treatment, or the priming treatment may be acted upon after a surface treatment such as the activation treatment or the like.

The front side, the back side, or both sides of the base may be coated with a hydrophilic binder; a semiconductor metal oxide such as alumina sol, tin oxide, and the like; and an electrification preventing agent such as carbon black and the like. Specific examples of the base are supports described in, for example, JP-A No. 63-220246.

-Thermoplastic Resin-

The thermoplastic resin is not particularly limited, and it may suitably be selected according to the purpose, and examples include polyolefin, polyvinyl chloride, polyethylene terephthalate, polystyrene, polymethacrylate, polycarbonate, polyimide, triacetyl cellulose, and the like, among which polyolefin is preferable. These resins may be used alone, or in combination of two or more.

Polyolefin is generally formed using low-density polyethylene, but in order to improve heat resistance of the support, it is preferable to use polypropylene, a blend of polypropylene and polyethylene, high-density polyethylene, a blend of high-density polyethylene and low-density polyethylene, or the like. Particularly, from the viewpoint of cost, laminate applicability, and the like, it is most preferable to use a blend of high-density polyethylene and low-density polyethylene.

For the blend of high-density polyethylene and low-density polyethylene, its blending ratio (mass ratio) ranges, for example, from 1:9 to 9:1. The blending ratio is preferably from 2:8 to 8:2, and more preferably from 3:7 to 7:3. When thermoplastic layers are formed on both sides of the support, the back side of the support is preferably formed using, for example, high-density polyethylene or a blend of high-density polyethylene and low-density polyethylene. The molecular weights of the high-density polyethylene and low-density polyethylene are not particularly limited, but it is preferable that melt indices of both high-density polyethylene and low-density polyethylene be from 1.0 g/10-min to 40 g/10-min and that the polyethylenes be suitable for extrusion.

A sheet or film of these may receive a treatment to obtain reflectivity of white color. Examples of the treatment include mixing a pigment such as titanium oxide or the like in the sheet or film.

In the present invention, double-side laminated paper is used as a support, and the thickness of the support is preferably 25 μm to 300 μm, more preferably 50 μm to 260 μm, and still more preferably 75 μm to 220 μm. The rigidity of the support may vary according to the purpose. It is preferred that the support used for the electrophotographic image-receiving sheet which gives photographic image quality be close to those used for color silver halide photography.

-Toner Image-Receiving Layer-

The above-mentioned toner image-receiving layer receives color and/or black toners and forms an image. The toner image-receiving layer has a function to receive toner which forms an image from a developing drum or an intermediate transfer by (static) electricity or pressure in a transferring step, and to fix the image by heat or pressure in a fixing step. The toner image-receiving layer contains a thermoplastic resin as a main component, and further contains a release agent and other components.

In such case, a toner image-receiving layer containing a thermoplastic resin is preferably formed on at least one side of the support. Preferably, the thickness of the toner image-receiving layer is from 5 μm to 20 μm, and more preferably 7 μm to 15 μm. This will result in obtaining prints with better texture in gloss.

-Thermoplastic Resin-

The thermoplastic resin is not particularly limited, and it may suitably be selected according to the purpose, provided that it is deformable under certain temperatures, for example during fixing, and that it accepts toner. However, a resin similar to the binder resin of a toner is preferable. Many toners employ a polyester resin or a copolymer resin such as styrene-butylacrylate, and in such case, the thermoplastic resin used for the electrophotographic image-receiving sheet preferably contains a polyester resin or a copolymer resin such as styrene-butylacrylate, more preferably 20% by mass or more of a polyester resin or a copolymer resin such as styrene-butylacrylate. Also preferable are styrene-acrylate copolymers, styrene-methacrylate copolymers, and the like.

Specific examples of the thermoplastic resins are (i) resins each having an ester bond, (ii) polyurethane resins and similar resins, (iii) polyamide resins and similar resins, (iv) polysulfone resins and similar resins, (v) poly(vinyl chloride) resins and similar resins, (vi) poly(vinyl butyral) and similar resins, (vii) polycaprolactone resins and similar resins, and (viii) polyolefin resins and similar resins.

The resins containing one or more ester bonds (i) include, for example, polyester resins obtained by condensation of a dicarboxylic acid component and an alcoholic component, polyacrylate resins or polymethacrylate resins such as polymethylmethacrylate, polybutylmethacrylate, polymethylacrylate, polybutyl acrylate, or the like; polycarbonate resins, polyvinyl acetate resins, styrene acrylate resins, styrene-methacrylate copolymer resins, vinyltoluene acrylate resins, or the like. Specific examples of the dicarboxylic acid component include terephthalic acid, isophthalic acid, maleic acid, fumaric acid, phthalic acid, adipic acid, sebacic acid, azelaic acid, abietic acid, succinic acid, trimellitic acid, pyromellitic acid, and the like. More preferably, the thermoplastic resin alone satisfies the preferable physical properties. Specific examples of the alcoholic component include ethylene glycol, diethylene glycol, propylene glycol, bisphenol A, diether derivative of bisphenol A (for example, ethylene oxide diadduct of bisphenol A, propylene oxide diadduct of bisphenol A) or bisphenol S, 2-ethyl cyclohexyldimethanol, neopentyl glycol, dicyclohexyldimethanol or glycerol. These may be substituted by hydroxyl groups.

Examples can also be found in JP-A Nos. 59-101395, 63-7971, 63-7972, 63-7973 and 60-294862.

Examples of commercial products of the polyester resins include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153 from Unitika Ltd.; Polyester TP-220 and R-188 from The Nippon Synthetic Chemical Industry Co., Ltd., and the like.

Examples of commercial products of the above-mentioned acrylic resins include SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; and FM601 from Mitsui Chemicals, Inc., and the like.

The polyvinyl chloride resin and the like (v) include, for example, polyvinylidene chloride resin, vinyl chloride-vinyl acetate copolymer resin, vinyl chloride-vinyl propionate copolymer resin, and the like.

The polyvinyl butyral and the like (vi) include, for example, polyol resins, cellulose resins such as ethyl cellulose resin and cellulose acetate resin, and the like. Examples of commercial products include ones by Denki Kagaku Kogyo Kabushikikaisha, Sekisui Chemical Co., Ltd., and the like. For polyvinyl butyral and the like, it is preferable that the amount of polyvinyl butyral contained be 70% by mass or more and the average extent of polymerization is 500 or more, and more preferably 1000 or more. Examples of commercial products include Denka Butyral 3000-1, 4000-2, 5000A, and 6000C by Denki Kagaku Kogyo Kabushikikaisha; S-LEC BL-1, BL-2, BL-S, BX-L, BM-1, BM-2, BM-5, BM-S, BH-3, BX-1, BX-7; and the like.

The polycaprolactone resin and the like (vii) include, for example, styrene-maleic anhydride resin, polyacrylonitrile resin, polyether resin, epoxy resin, phenol resin, and the like.

The polyolefin resin and the like (viii) include, for example, polyethylene resin, polypropylene resin, copolymer resins of olefins such as ethylene, propylene, or the like with other vinyl monomers, acrylic resins, and the like.

The thermoplastic resins may be used alone or in combination of two or more, and in addition, a mixture, a copolymer of these resins, and the like may be used.

The thermoplastic resin preferably satisfies toner image-receiving layer properties, which will be described later, when formed into a toner image-receiving layer, and more preferably satisfies the toner image-receiving layer properties by itself. It is also preferable to use in combination two or more resins which have different toner image-receiving layer properties.

The thermoplastic resin preferably has a molecular weight that is larger than that of a thermoplastic resin used in the toner. However, according to the relationship of the thermodynamic properties of the thermoplastic resin used in the toner and the properties of the resin used in the toner image-receiving layer, the relationship of the molecular weights as described above is not necessarily preferable. For example, when a softening temperature of the resin used in the toner image-receiving layer is higher than that of the thermoplastic resin used in the toner, there are cases in which molecular weight of the resin used in the toner image-receiving layer is preferably the same or smaller.

It is also preferred that the thermoplastic resin be a mixture of resins with identical compositions having different average molecular weights. The preferable relationship with molecular weights of thermoplastic resins used in toners is disclosed in JP-A No. 08-334915.

Molecular weight distribution of the thermoplastic resin is preferably wider than that of the thermoplastic resin used in the toner.

It is preferred that the thermoplastic resin satisfies the physical properties disclosed in JP-A Nos. 05-127413, 08-194394, 08-334915, 08-334916, 09-171265, 10-221877, and the like.

It is particularly preferable that the thermoplastic resin used in a toner image-receiving layer be an aqueous resin such as water-soluble resin, water-dispersible resin, or the like for the following reasons (1) and (2). (1) Since no organic solvent is discharged in coating and drying processes, it is excellent in environmental preservation and workability. (2) Since many release agents such as wax are difficult to dissolve in a solvent at room temperature, often they are dispersed in a solvent (water or an organic solvent) before use. Further, an aqueous dispersion is more stable and is excellently suitable for a manufacturing process. In addition, with aqueous coating, wax bleeds on the surface more easily during the process of coating and drying, and the effects of a release agent (offset resistance, adhesion resistance, and the like) is facilitated more easily.

The aqueous resin is not particularly limited with regards to its composition, bonding structure, molecular weight, molecular weight distribution, and formation, provided that it is an aqueous resin, water-dispersible resin, or the like. Examples of substituting groups which render a resin aqueous include sulfonic acid group, hydroxyl group, carboxylic acid group, amino group, amide group, ether group, and the like.

Examples of the water-soluble resins are given on page 26 of Research Disclosure No. 17,643, page 651 of Research Disclosure No. 18,716, pp. 873-874 of Research Disclosure No. 307,105, and pp. 71-75 of JP-A No. 64-13546.

Specific examples include a vinyl pyrrolidone-vinyl acetate copolymer, styrene-vinyl pyrrolidone copolymer, styrene-maleic anhydride copolymer, water-soluble polyester, water-soluble acrylic, water-soluble polyurethane, water-soluble nylon, a water-soluble epoxy resin, and the like. Gelatin may be selected from lime treated gelatin, acid treated gelatin, or so-called delimed gelatin in which the amount of calcium and the like is reduced, and it may also be used in combination. Examples of commercial products of aqueous polyester include various Plascoat products by Goo Chemical Co., Ltd., Finetex ES series by Dainippon Ink and Chemicals Inc., and the like; and those of aqueous acrylic resins include Jurymer AT series by Nihon Junyaku Co., Ltd., Finetex 6161 and K-96 by Dainippon Ink and Chemicals Inc., Hiros NL-1189 and BH-997 by Seiko Chemical Industries Co., Ltd., and the like.

The water-dispersible resin may suitably be selected from water-dispersed resins such as water-dispersed acrylic resin, water-dispersed polyester resin, water-dispersed polystyrene resin, water-dispersed urethane resin, and the like; emulsions such as acrylic resin emulsion, polyvinyl acetate emulsion, SBR (styrene butadiene rubber) emulsion, and the like; resins and emulsions in which the thermoplastic resins of (i) to (viii) are water dispersed; and copolymers thereof, mixtures thereof, and those which are cation-modified. Two or more of these may be used in combination.

Examples of commercial products of the water-dispersible resins include, for polyester resins, Vylonal series by Toyobo Co., Ltd., Pesresin A series by Takamatsu Oil & Fat Co., Ltd., Tuftone UE series by Kao Corp., Nichigo Polyester WR series by Nippon Synthetic Chemical Industry Co., Ltd., Elitel series by Unitika Ltd., and the like; and for acrylic resins, Hiros XE, KE, and PE series by Seiko Chemical Industries Co., Ltd., Jurymer ET series by Nihon Junyaku Co., Ltd., and the like.

The minimum film-forming temperature (MFT) of the polymer is preferably room temperature or higher, from the viewpoint of pre-print storage, and preferably 100° C. or lower, from the viewpoint of fixing toner particles.

It is desirable to use a self-dispersing aqueous polyester resin emulsion satisfying the following properties (1) to (4) as the above-mentioned thermoplastic resin in present invention. As this is a self-dispersing type which does not use a surfactant, its hygroscopicity is low even in a high humidity environment, its softening point is not much reduced by moisture, and offset produced during fixing, or sticking of sheets in storage, can be suppressed. Moreover, since it is aqueous, it is very environment-friendly and has excellent workability. As it uses a polyester resin which easily assumes a molecular structure with high cohesion energy, it has sufficient hardness in a storage environment, assumes a melting state of low elasticity (low viscosity) in the fixing step for electrophotography, and toner is embedded in the toner image-receiving layer so that a sufficiently high image quality is attained.

(1) The number average molecular weight (Mn) is preferably 5000 to 10000, and more preferably 5000 to 7000.
(2) The molecular weight distribution (Mw/Mn) (weight average molecular weight/number average molecular weight) is preferably 4 or less, and more preferably 3 or less.
(3) The glass transition temperature (Tg) is preferably 40° C. to 100° C., and more preferably 50° C. to 80° C.
(4) The volume average particle diameter is preferably 20 nm to 200 nm, and more preferably 40 nm to 150 nm.

A content of the thermoplastic resin in the toner image-receiving layer is preferably 10% by mass to 90% by mass, and more preferably 30% by mass to 90% by mass.

-Releasing Agent-

The releasing agent can be at least one of silicone compounds, fluorine compounds, waxes, and matting agents. Among them, at least one selected from silicone oils, polyethylene waxes, carnauba waxes, silicone particles, and polyethylene wax particles is preferably used.

Specifically, the releasing agent may for example be a compound mentioned in "Properties and Applications of Wax (Revised)" by Saiwai Publishing, or in the Silicone Handbook published by THE NIKKAN KOGYO SHIMBUN. Also, the silicone compounds, fluorine compounds and wax in the toners mentioned in Japanese Patent Application Publication (JP-B) No. 59-38581, Japanese Patent Application Publication (JP-B) No. 04-32380, Japanese Patent (JP-B) No. 2838498, JP-B No. 2949558, Japanese Patent Application Laid-Open (JP-A) No. 50-117433, No. 52-52640, No. 57-148755, No. 61-62056, No. 61-62057, No. 61-118760, and JP-A No. 02-42451, No. 03-41465, No. 04-212175, No. 04-214570, No. 04-263267, No. 05-34966, No. 05-119514, No. 06-59502, No. 06-161150, No. 06-175396, No. 06-219040, No. 06-230600, No. 06-295093, No. 07-36210, No. 07-43940, No. 07-56387, No. 07-56390, No. 07-64335, No. 07-199681, No. 07-223362, No. 07-287413, No. 08-184992, No. 08-227180, No. 08-248671, No. 08-248799, No. 08-248801, No. 08-278663, No. 09-152739, No. 09-160278, No. 09-185181, No. 09-319139, No. 09-319143, No. 10-20549, No. 10-48889, No. 10-198069, No. 10-207116, No. 11-2917, No. 11-44969, No. 11-65156, No. 11-73049 and No. 11-194542 may be used. These compounds can also be used in combination of two or more.

Examples of the silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 series, TSF451 series, TSF456, TSF458 series, TSF483, TSF484, TSF4045, TSF4300, TSF4600, YF33 series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (for example, KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (for example, BY16-880 from Dow Corning Toray Silicone Co., Ltd., TSF4770 and XF42-A9248 from GE Toshiba Silicones), carbinol-modified silicone oils (for example, XF42-B0970 from GE Toshiba Silicones), vinyl-modified silicone oils (for example, XF40-A1987 from GE Toshiba Silicones), epoxy-modified silicone oils (for example, SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (for example, KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oil, mercapto-modified silicone oil, alcohol-modified silicone oil (for example, SF8427 and SF8428 from Dow Corning Toray Silicone Co., Ltd., TSF4750, TSF4751 and XF42-B0970 from GE Toshiba Silicones), alkyl-modified silicone oils (for example, SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (for example, FS1265 from Dow Corning Toray Silicone Co., Ltd., and FQF501 from GE Toshiba Silicones), silicone rubbers and silicone fine particles (for example, SH851U, SH745U, SH55UA, SE4705U, SH502 UA&B, SRX539U, SE6770 U-P, DY38-038, DY38-047, Torayfil F-201, F-202, F-250, R-900, R-902A, E-500, E-600, E-601, E-506, BY29-119 from Dow Corning Toray Silicone Co., Ltd.; Tospearl 105, Tospearl 120, Tospearl 130, Tospearl 145, Tospearl 240 and Tospearl 3120 from GE Toshiba Silicones), silicone-modified resins (specifically, olefin resins, polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, and the like), and the like. Examples of the commercial products include Daiallomer SP203V, SP712, SP2105 and SP3023 from Dainichiseika Color & Chemicals Mfg. Co., Ltd.; Modiper FS700, FS710, FS720, FS730 and FS770 from NOF Corp.; Symac US-270, US-350, US-352, US-380, US-413, US-450, Reseda GP-705, GS-30, GF-150 and GF-300 from TOAGOSEI CO., LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type. Commercial examples thereof include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of the fluorine compounds include fluorine oils (for example, Daifluoryl #1, Daifluoryl #3, Daifluoryl #10, Daifluoryl #20, Daifluoryl #50, Daifluoryl #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC-430 and FC-431 from DU PONT-MITSUI FLUORO-CHEMICALS COMPANY, LTD.), fluoro rubbers (for example, LS63U from Dow Corning Toray Silicone Co., Ltd.), fluorine-modified resins (for example, Modepa F200, F220, F600, F220, F600, F2020, F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (for example, EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of the wax include synthetic hydrocarbon, modified wax, hydrogenated wax, natural wax, and the like.

Examples of the synthetic hydrocarbon include polyethylene wax (for example, polyron A, 393, and H-481 from Chukyo Yushi Co., Ltd.; Sunwax E-310, E-330, E-250P, LEL-250, LEL-800, LEL-400P, from SANYO KASEI Co., Ltd.), polypropyrene wax (for example, biscoal 330-P, 550-P, 660-P from SANYO KASEI Co., Ltd.), Fischer toropush wax (for example, FT100, and FT-0070, from Nippon Seiro Co., Ltd.), an acid amide compound or an acid imide compound (specifically, stearic acid amide, anhydrous phthalic acid imide, or the like; for example, Cellusol 920, B-495, hymicron G-270, G-110, hydrine D-757 from Chukyo Yushi Co., Ltd.), and the like.

Examples of the modified wax include amine-modified polypropyrene (for example, QN-7700 from SANYO KASEI Co., Ltd.), acrylic acid-modified wax, fluorine-modified wax, olefin-modified wax, urethane wax (for example, NPS-6010, and HAD-5090 from Nippon Seiro Co., Ltd.), alcohol wax (for example, NPS-9210, NPS-9215, OX-1949, XO-020T from Nippon Seiro Co., Ltd.), and the like.

Examples of the hydrogenated wax include cured castor oil (for example, castor wax from Itoh Oil Chemicals Co., Ltd.), castor oil derivatives (for example, dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D-4 ester, castor oil urethane acrylate CA-10, CA-20, CA-30, castor oil derivative MINERASOL S-74, S-80, S-203, S-42X, S-321, special castor oil condensation aliphatic acid MINERASOL RC-2, RC-17, RC-55, RC-335, special castor oil condensation aliphatic acid ester MINERASOL LB-601, LB-603, LB-604, LB-702, LB-703, #11 and L-164 from Itoh Oil Chemicals Co., Ltd.), stearic acid (for example, 12-hydroxystearic acid from Itoh Oil Chemicals Co., Ltd.), lauric acid, myristic acid, palmitic acid, behenic acid, sebacic acid (for example, sebacic acid from Itoh Oil Chemicals Co., Ltd.), undecylenic acid (for example, undecylenic acid from Itoh Oil Chemicals Co., Ltd.), heptyl acids (heptyl acids from Itoh Oil Chemicals Co., Ltd.), maleic acid, high grade maleic oils (for example, HIMALEIN DC-15, LN-10, LN-00-15, DF-20 and SF-20 from Itoh Oil Chemicals Co., Ltd.), blown oils (for example, selbonol #10, #30, #60, R-40 and S-7 from Itoh Oil Chemicals Co., Ltd.), cyclopentadieneic oil (CP oil and CP oil-S from Itoh Oil Chemicals Co., Ltd., or the like), and the like.

The natural wax is preferably any wax selected from vegetable wax, animal wax, mineral wax, and petroleum wax, among which vegetable wax is particularly preferable. The natural wax is also preferably a water-dispersible wax, from the viewpoint of compatibility when a water-dispersible thermoplastic resin is used as the thermoplastic resin in the toner image-receiving layer.

Examples of the vegetable wax include carnauba wax (for example, EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candellila wax, Japan wax, jojoba oil, and the like. Of these, carnauba wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the animal wax include bees wax, lanolin, spermaceti, whale oil, wool wax, and the like.

Examples of the mineral wax include montan wax, montan ester wax, ozokerite, ceresin, and the like, aliphatic acid esters (Sansosizer-DOA, AN-800, DINA, DIDA, DOZ, DOS, TOTM, TITM, E-PS, nE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the petroleum wax include paraffin wax (for example, Paraffin wax 155, Paraffin wax 150, Paraffin wax 140, Paraffin wax 135, Paraffin wax 130, Paraffin wax 125, Paraffin wax 120, Paraffin wax 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Oils and Fats Co., Ltd.; Cellosol 686, Cellosol 428, Cellosol 651-A, Cellosol A, H-803, B-460, E-172, E-866, K-133, hydrin D-337 and E-139 from Chukyo Yushi Co., Ltd.; 125° paraffin, 125° FD, 130° paraffin, 135° paraffin, 1350 H, 140° paraffin, 140° N, 1450 paraffin and paraffin wax M from Nippon Oil Corporation), or a microcrystalline wax (for example, Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Nippon Oils and Fats Co., Ltd; Cellosol 967, M, from Chukyo Yushi Co., Ltd.; 155 Microwax and 180 Microwax from Nippon Oil Corporation), and petrolatum (for example, OX-1749, OX-0450, OX-0650B, OX-0153, OX-261BN, OX-0851, OX-0550, OX-0750B, JP-1500, JP-056R and JP-011P from Nippon Oils and Fats Co., Ltd.), and the like.

A content of the natural wax in the toner image-receiving layer (a surface) is preferably 0.1 g/m$^2$ to 4 g/m$^2$, and more preferably 0.2 g/m$^2$ to 2 g/m$^2$.

If the content is less than 0.1 g/m$^2$, the anti-offset properties and the adhesive resistance deteriorate. If the content is more than 4 g/m$^2$, the quality of an image may deteriorate because of the excessive amount of wax.

The melting point of the natural wax is preferably 70° C. to 95° C., and more preferably 75° C. to 90° C., from a viewpoint of anti-offset properties and paper transporting properties.

The matting agent can be selected from any known matting agent. Solid particles for use in the matting agents can be classified as inorganic particles (inorganic matting agents) and organic particles (organic matting agents).

Specifically, the inorganic matting agents may be oxides (for example, silicon dioxide, titanium oxide, magnesium oxide, aluminum oxide), alkaline earth metal salts (for example, barium sulfate, calcium carbonate, and magnesium sulfate), silver halides (for example, silver chloride, and silver bromide), glass, and the like.

Examples of the inorganic matting agents can be found, for example, in West German Patent No. 2529321, the U.K. Patent Nos. 760775, 1260772, and the U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the organic matting agent include starch, cellulose ester (for example, cellulose-acetate propionate), cellulose ether (for example, ethyl cellulose) and a synthetic resin. It is preferred that the synthetic resin is insoluble or difficult to become solved. Examples of insoluble or difficult to become solved in synthetic resins include poly(meth) acrylic acid esters (for example, polyalkyl(meth) acrylate, polyalkoxyalkyl(meth)acrylate, polyglycidyl(meth)acrylate), poly(meth) acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole, polyvinylidene chloride, and the like. Copolymers which combine the monomers used in the above polymers, may also be used.

In the case of the copolymers, a small amount of hydrophilic repeated units may be included. Examples of monomers which form a hydrophilic repeated unit include acrylic acid, methacrylic acid, á,â-unsaturated dicarboxylic acid, hydroxyalkyl(meth)acrylate, sulfoalkyl (meth)acrylate, styrene sulfonic acid, and the like.

Examples of the organic matting agents can be found, for example, in the U.K. Patent No. 1055713, the U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in conjunction as matting agents. The average particle size of the solid particles of the matting agent may suitably be, for example, 1 $\mu$m to 100 $\mu$m, and is more preferably 4 $\mu$m to 30 $\mu$m. The usage amount of the matting agent may suitably be 0.01 g/m$^2$ to 0.5 g/m$^2$, and is more preferably 0.02 g/m$^2$ to 0.3 g/m$^2$.

The releasing agents for use in the toner-image-receiving layer can also be derivatives, oxides, purified products, and mixtures of the aforementioned substances. These may also have reactive substituents.

The melting point (° C.) of the releasing agent is preferably 70° C. to 95 ° C., and more preferably 75° C. to 90° C., from the viewpoints of anti-offset properties and paper transport properties.

The releasing agent is also preferably a water-dispersible releasing agent, from the viewpoint of compatibility when a water-dispersible thermoplastic resin is used as the thermoplastic resin in the toner image-receiving layer.

The content of the releasing agent in the toner image-receiving layer is preferably 0.1% by mass to 10% by mass, more preferably 0.3% by mass to 8.0% by mass, and still more preferably 0.5% by mass to 5.0% by mass.

-Other Components-

Other components include various additives which are added in order to improve thermoplastic properties of a toner image-receiving layer, for example, a colorant, plasticizer, filler, cross-linking agent, electrification control agent, emulsifier, dispersant, and the like.

Examples of colorants include fluorescent whitening agents, white pigments, colored pigments, dyes, and the like.

The fluorescent whitening agent has absorption in the near-ultraviolet region, and is a compound which emits fluorescence at 400 nm to 500 nm. The various fluorescent whitening agent known in the art may be used without any particular limitation. Examples of the fluorescent whitening agent include the compounds described in "The Chemistry of Synthetic Dyes" Volume V, Chapter 8 edited by K. VeenRataraman. Specific examples of the fluorescent whitening agent include stilbene compounds, coumarin compounds, biphenyl compounds, benzo-oxazoline compounds, naphthalimide compounds, pyrazoline compounds, carbostyryl compounds, and the like. Examples of the commercial fluorescent whitening agents include WHITEX PSN, PHR, HCS, PCS, and B from Sumitomo Chemicals, UVITEX-OB from Ciba-Geigy, Co., Ltd., and the like.

Examples of the white pigments include the inorganic pigments (for example, titanium oxide, calcium carbonate, and the like).

Examples of the colored pigments include various pigments and azo pigments described in JP-A No. 63-44653, (for example, azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (for example, phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (for example, malachite green, rhodamine B, rhodamine G and Victoria blue B), and inorganic pigment (for example, oxide, titanium dioxide, iron oxide red, sulfate; settling barium sulfate, carbonate; settling calcium carbonate, silicate; hydrous silicate, silicic anhydride, metal powder; alminium powder, bronze powder, zinc powder, carbon black, chrome yellow, iron blue, or the like) and the like.

These may be used either alone, or in combination of two or more. Of these, titanium oxide is particularly preferred as the pigment.

There is no particular limitation on the form of the pigment. However, hollow particles are preferred from the viewpoint that they have excellent heat conductivity (low heat conductivity) during image fixing.

The various dyes including oil-soluble dyes, water-insoluble dyes, and the like may be used as the dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and other dyes such as C.I. solvent violet 13, C.I. solvent violet 14, C.I. solvent violet 21, C.I. solvent violet 27, bC.I. solvent blue 11, C.I. solvent blue 12, C.I. solvent blue 25, C.I. solvent blue 55, or the like.

Colored couplers used in silver halide photography may also be preferably used.

A content of the colorant in the toner image-receiving layer (surface) is preferably 0.1 $g/m^2$ to 8 $g/m^2$, and more preferably 0.5 $g/m^2$ to 5 $g/m^2$.

If the content of colorant is less than 0.1 $g/m^2$, the light transmittance in the toner image-receiving layer becomes high. If it is more than 8 $g/m^2$, handling becomes more difficult, due to crack and adhesive resistance.

In the colorant, an amount of the pigment to be added is, based on the mass of the thermoplastic resin which forms the toner image-receiving layer, less than 40% by mass, more preferably less than 30% by mass, and still more preferably less than 20% by mass.

The plasticizers known in the art may be used without any particular limitation. These plasticizers have the effect of adjusting the fluidity or softening of the toner image-receiving layer due to heat and/or pressure.

The plasticizer may be selected by referring to "Chemical Handbook," (Chemical Institute of Japan, Maruzen), "Plasticizers—their Theory and Application," (ed. Koichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Examples of the plasticizers include phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters, and the like; amides (for example, aliphatic acid amides and sulfoamides); ethers; alcohols; lactones; polyethyleneoxy; and the like (See, for example, JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646 and 02-235694, and the like). The plasticizers can be mixed into a resin.

The plasticizers may be polymers having relatively low molecular weight. In this case, it is preferred that the molecular weight of the plasticizer is lower than the molecular weight of the binder resin to be plasticized. Preferably, plasticizers have a molecular weight of 15000 or less, or more preferably 5000 or less. When a polymer plasticizer is used as the plasticizer, the polymer of the polymer plasticizer is the same as that of the binder resin to be plasticized. For example, when the polyester resin is plasticized, polyester having low molecular weight is preferable. Further, oligomers may also be used as plasticizers. Apart from the compounds mentioned above, there are commercially products such as, for example, Adecasizer PN-170 and PN-1430 from Asahi Denka Co., Ltd.; PARAPLEX-G-25, G-30 and G-40 from C. P. Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The plasticizer can be used as desired to relax stress and distortion (physical distortions of elasticity and viscosity, and distortions of mass balance in molecules, binder main chains or pendant portions) which are produced when toners are embedded in the toner image-receiving layer.

The plasticizer may be dispersed in micro in the toner image-receiving layer. The plasticizer may also be dispersed in micro in a state of sea-island, in the toner image-receiving layer. The plasticizer may present in the toner image-receiving layer in a state of sufficiently mixed with other components such as binder or the like.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purpose of adjusting slidability (improvement of transportability by reducing friction), improving fixing part offset (release of toner or layer to the fixing part), adjusting electrification (formation of a toner electrostatic image), and the like.

The filler may be an organic or inorganic filler. Reinforcers for binder resins, bulking agents and reinforcements known in the art may be used.

The filler may be one of those described in "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers (or pigments) can be used. Examples of inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Silica and alumina are particularly preferred. These fillers may be used either alone or in combination of two or more. It is preferred that the filler has a small particle diameter. If the particle diameter is large, the surface of the toner image-receiving layer may tend to become rough.

Examples of the silica include spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 4 nm to 120 nm, and more preferably 4 nm to 90 nm.

The silica is preferably porous. The average pore size of porous silica is preferably 50 nm to 500 nm. The average pore volume per mass of porous silica is preferably 0.5 ml/g to 3 ml/g, for example.

The alumina includes anhydrous alumina and hydrated alumina. Examples of crystallized anhydrous aluminas which may be used, are $\alpha$, $\beta$, $\gamma$, $\delta$, $\zeta$, $\eta$, $\theta$, $\kappa$, $\rho$, or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is around 0.3 ml/g to 3 ml/g.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

The filler is preferably from 5 parts by mass to 2000 parts by mass relative to 100 parts of the dry mass of the binder of a layer to which it is added.

A crosslinking agent can be added in order to adjust the storage stability or thermoplastic properties of the toner image-receiving layer. Examples of the crosslinking agent include compounds containing two or more reactive groups in the molecule, such as an epoxy group, an isocyanate group, an aldehyde group, an active halogen group, an active methylene group, an acetylene group and other reactive groups known in the art.

The cross-linking agent may also be a compound having two or more groups capable of forming bonds such as hydrogen bonds, ionic bonds, stereochemical bonds, or the like.

The cross-linking agent may be a compound known in the art such as a coupling agent for resin, curing agent, polymerizing agent, polymerization promoter, coagulant, film-forming agent, film-forming assistant, or the like. Examples of the coupling agents include chlorosilanes, vinylsilanes, epoxysilanes, aminosilanes, alkoxyaluminum chelates, titanate coupling agents, and the like. The examples further include other agents known in the art such as those mentioned in Handbook of Rubber and Plastics Additives (ed. Rubber Digest Co.).

The charge control agent preferably adjusts transfer and adhesion of toner, and prevents charge adhesion of a toner image-receiving layer.

The charge control agent may be any charge control agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like.

Examples of the surfactant include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as aliphatic ester, polyethylene oxide, or the like. When the toner has a negative charge, cationic charge control agent and nonionic charge control agent, for example, are preferable.

Examples of the electroconducting metal oxides include ZnO, $TiO_2$, $SnO_2$, $Al_2O_3$, $In_2O_3$, $SiO_2$, MgO, BaO, $MoO_3$, and the like. These may be used alone, or in combination of two or more.

Moreover, the metal oxide may contain other elements. For example, ZnO may contain Al, In, or the like, $TiO_2$ may contain Nb, Ta, or the like, and $SnO_2$ may contain (or, dope) Sb, Nb, halogen elements, or the like.

The materials used to obtain the toner image-receiving layer may also contain various additives to improve image stability when output, or to improve stability of the toner image-receiving layer itself. Examples of the additives include antioxidants, age resistors, degradation inhibitors, anti-ozone degradation inhibitors, ultraviolet ray absorbers, metal complexes, light stabilizers, preservatives, fungicide, and the like.

Examples of the antioxidants include chroman compounds, coumarane compounds, phenol compounds (for example, hindered phenols), hydroquinone derivatives, hindered amine derivatives, spiroindan compounds, and the like. The antioxidants can be found, for example, in JP-A No. 61-159644.

Examples of age resistors include those found in Handbook of Rubber and Plastics Additives, Second Edition (1993, Rubber Digest Co.), pp. 76-121.

Examples of the ultraviolet ray absorbers include benzotriazo compounds (described in the U.S. Pat. No. 3,533,794), 4-thiazolidone compounds (described in the U.S. Pat. No. 3,352,681), benzophenone compounds (described in JP-A No. 46-2784), ultraviolet ray absorbing polymers (described in JP-A No. 62-260152).

Examples of the metal complex include those described in U.S. Pat. Nos. 4,241,155, 4,245,018, 4,25,4195, JP-A Nos. 61-88256, 62-174741, 63-199248, 01-75568, 01-74272, and the like.

Additives for photography known in the art may also be added to the material used to obtain the toner image-receiving layer as described above. Examples of the photographic additives can be found in the Journal of Research Disclosure (hereinafter referred to as RD) No. 17643 (December 1978), No. 18716 (November 1979) and No. 307105 (November 1989). The relevant sections are shown.

| Type of additive | RD17643 | RD18716 | RD307105 |
|---|---|---|---|
| 1. Whitener | p.24 | p.648 right column | p.868 |
| 2. Stabilizer | pp.24–25 | p.649 right column | pp.868–870 |
| 3. Light absorber (Ultraviolet ray absorber) | pp.25–26 | p.649 right column | pp.873 |
| 4. Colorant image stabilizer | p.25 | p.650 right column | p.872 |
| 5. Film hardener | p.26 | p.651 left column | p.874–875 |
| 6. Binder | p.26 | p.651 left column | p.873–874 |
| 7. Plasticizer, lubricant | p.27 | p.650 right column | p.876 |
| 8. Auxiliary application agent (Surfactant) | pp.26–27 | p.650 right column | pp.875–876 |
| 9. Antistatic agent | p.27 | p.650 right column | p.876–877 |
| 10. Matting agent | | | pp.878–879 |

The toner image-receiving layer of the present invention is formed by applying a coating solution which contains the polymer used for the toner image-receiving layer with a wire coater or the like onto the support, and drying the coating solution. The coating solution is prepared by dissolving or uniformly dispersing an additive such as a thermoplastic polymer, a plasticizer, or the like, into an organic solvent such as alcohol, ketone, or the like. The organic solvent used here may for example be methanol, isopropyl alcohol, methyl ethyl ketone, or the like. If the polymer used for the toner image-receiving layer is water-soluble, the toner image-receiving layer can be prepared by applying an aqueous solution of the polymer onto the support. Polymers which are not water-soluble may be applied onto the support in an aqueous dispersion.

The film-forming temperature of the polymer used in the present invention is preferably room temperature or higher, from the viewpoint of pre-print storage, and preferably 100° C. or lower, from the viewpoint of fixing toner particles.

-Physical Properties of Toner Image-receiving Layer-

The 180° separation strength of the toner image-receiving layer at the fixing temperature by the fixing member is preferably 0.1 N/25 mm or less, and more preferably 0.041 N/25 mm or less. The 180° separation strength can be measured based on the method described in JIS K6887 using the surface material of the fixing member.

It is preferred that the toner image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in a (L*a*b*) space.

It is preferred that the toner image-receiving layer has a high smoothness. The arithmetic average roughness (Ra) is preferably 3 μm or less, more preferably 1 μm or less, and still more preferably 0.5 μm or less, over the whole range from white where there is no toner, to black where toner is densed at maximum.

Arithmetic average roughness may be measured by JIS B 0601, B 0651, and B 0652.

It is preferred that the toner image-receiving layer has one of the following physical properties, more preferred that it has several of the following physical properties, and most preferred that it has all of the following physical properties.

(1) $T_m$ (Melting temperature) of the toner image-receiving layer is 30° C. or more, and equal to or less than $T_m$+20° C. of the toner.

(2) The temperature at which the viscosity of the toner image-receiving layer is $1\times10^5$ Cp is 40° C. or higher, lower than the corresponding temperature for the toner.

(3) At a fixing temperature of the toner image-receiving layer, the storage elasticity modulus (G') is $1\times10^2$ Pa to $1\times10^5$ Pa, and the loss elasticity modulus (G") is $1\times10^2$ Pa to $1\times10^5$ Pa.

(4) The loss tangent (G"/G'), which is the ratio of the loss elasticity modulus (G") and the storage elasticity modulus (G') at a fixing temperature of the toner image-receiving layer, is 0.01 to 10.

(5) The storage modulus (G') at a fixing temperature of the toner image-receiving layer is from −50 to +2500, relative to the storage elasticity modulus (G") at a fixing temperature of the toner.

(6) The inclination angle on the toner image-receiving layer of the molten toner is 50° or less, and particularly preferably 40° or less.

The toner image-receiving layer preferably satisfies the physical properties described in Japanese Patent No. 2788358, and JP-A Nos. 07-248637, 08-305067 and 10-239889.

Other layers may include, for example, a surface protective layer, backing layer, contact improving layer, intermediate layer, undercoat, cushion layer, charge control (inhibiting) layer, reflecting layer, tint adjusting layer, storage ability improving layer, anti-adhering layer, anti-curl layer, smoothing layer, and the like. These layers may have a single-layer structure or may be formed of two or more layers.

A surface protective layer may be disposed on the surface of the toner image-receiving layer to protect the surface of the electrophotographic image-receiving sheet, to improve storage properties, to improve ease of handling, to facilitate writing, to improve paper transporting properties within an equipment, to confer anti-offset properties, or the like. The surface protective layer may comprise one layer, or two or more layers. In the surface protective layer, various thermoplastic resins or thermosetting resins may be used as binders, and are preferably the same types of resins as those of the toner image-receiving layer. However, the thermodynamic properties and electrostatic properties are not necessarily identical to those of the toner image-receiving layer, and may be individually optimized.

The surface protective layer may comprise the various additives described above which can be used for the toner image-receiving layer. In particular, in addition to the releasing agents for the present invention, the surface protective layer may include other additives, for example matting agents or the like. The matting agents may be any of these used in the related art.

From the viewpoint of fixing properties, it is preferred that the outermost surface layer of the electrophotographic image-receiving sheet (which refers to, for example, the surface protective layer, if disposed) has good compatibility with the toner. Specifically, it is preferred that the contact angle with molten toner is, for example, from 0° to 40°.

It is preferred that, in the electrophotographic image-receiving sheet, a backing layer is disposed on the opposite surface to the surface on which the support is disposed, in order to confer back surface output compatibility, and to improve back surface output image quality, curl balance and paper transporting properties within equipment.

There is no particular limitation on the color of the backing layer. However, if the electrophotographic image-receiving sheet of the invention is a double-sided output image-receiving sheet where an image is formed also on the back surface, it is preferred that the backing layer is also white. It is preferred that the whiteness and spectral reflectance are 85% or more, for both the top surface and the back surface.

To improve double-sided output compatibility, the backing layer may have an identical structure to that of the toner image-receiving layer. The backing layer may comprise the various additives described hereintofore. Of these additives, matting agents and charge control agents are particularly suitable. The backing layer may be a single layer, or may have a laminated structure comprising two or more layers.

Further, if releasing oil is used for the fixing roller or the like, to prevent offset during fixing, the backing layer may have oil absorbing properties.

In the electrostatic image-receiving sheet, it is preferred to dispose a contact improving layer in order to improve the contact between the support and the toner image-receiving layer. The contact improving layer may contain the various additives described above. Of these, cross-linking agents are particularly preferred to be blended in the contact improving layer. Furthermore, to improve accepting properties to toner, it is preferred that the electrophotographic image-receiving sheet further comprises a cushion layer between the contact improving layer and the toner image-receiving layer.

An intermediate layer may for example be disposed between the support and a contact improvement layer, between a contact improvement layer and a cushion layer, between a cushion layer and a toner image-receiving layer, or between a toner image-receiving layer and a storage property improvement layer. In the case of an electrophotographic image-receiving sheet comprising a support, a toner image-receiving layer and an intermediate layer, the intermediate layer may of course be disposed for example between the support and the toner image-receiving layer.

The thickness of the electrophotographic image-receiving sheet of the present invention can be suitably selected according to the purpose without particular limitation. The thickness is preferably 50 $\mu$m to 350 $\mu$m, and more preferably 100 $\mu$m to 280 $\mu$m.

<Toner>

In the electrophotographic image-receiving sheet, the toner image-receiving layer receives toners during printing or copying.

The toner contains at least a binder resin and a colorant, but may contain releasing agents and other components, if necessary.

-Binder Resin for Toner-

Examples of the binder resin include vinyl monopolymer of: styrenes such as styrene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, á-methyl chloroacrylate, methyl methacrylate, ethyl methacrylate, butyl acrylate, or the like; vinyl nitrites such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. These vinyl monomers may be used either alone, or copolymers thereof may be used. Further, various polyesters may be used, and various waxes may be used in combination.

Of these resins, it is preferable to use a resin of the same type as the resin used for the toner image-receiving layer of the present invention.

-Colorants for the Toner-

The colorants generally used in the art can be used without limitation. Examples of the colorants include various pigments such as carbon black, chrome yellow, Hansa yellow, benzidine yellow, threne yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used either alone, or in combination of a plurality of colorants.

It is preferred that the content of the colorant is 2% by mass to 8% by mass. If the content of colorant is 2% by mass or more, the coloration does not become weaker. If it is 8% by mass or less, transparency does not deteriorate.

-Releasing agent for the Toner-

The releasing agent may be in principle any of the wax known in the art. Polar wax containing nitrogen such as highly crystalline polyethylene wax having relatively low molecular weight, Fischertropsch wax, amide wax, urethane wax, and the like are particularly effective. For polyethylene wax, it is particularly effective if the molecular weight is 1000 or less, and is effective more preferably if the molecular weight is 300 to 1000.

Compounds containing urethane bonds have a solid state due to the strength of the cohesive force of the polar groups even if the molecular weight is low, and as the melting point can be set high in view of the molecular weight, they are suitable. The preferred molecular weight is 300 to 1000. The initial materials may be selected from various combinations such as a diisocyane acid compound with a mono-alcohol, a monoisocyanic acid with a mono-alcohol, dialcohol with mono-isocyanic acid, tri-alcohol with a monoisocyanic acid, and a triisocyanic acid compound with mono-alcohol. However, in order to prevent the molecular weight from becoming too large, it is preferable to combine a compound having multiple functional groups with another compound having one functional group, and it is important that the amount of functional groups be equivalent.

Among the initial materials, examples of the monoisocyanic acid compounds include dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate, 4'-diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohol include ordinary alcohols such as methanol, ethanol, propanol, butanol, pentanol, hexanol, heptanol, and the like.

Among the initial materials, examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be mixed with the resin or the colorant during kneading, as an ordinary releasing agent, and used also as a kneaded-crushed toner. Further, in a case of using an emulsion polymerization cohesion scarification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of lim or less, which can be used together with a resin particle dispersion, colorant dispersion, or the like.

-Toner, Other Components-

The toner of the present invention may also contain other components such as internal additives, charge control agents, inorganic particles, or the like. Examples of the internal additives include metals such as ferrite, magnetite, reduced iron, cobalt, nickel, manganese, or the like; alloys or magnets such as compounds containing these metals.

Examples of the charge control agents include dyes such as quaternary ammonium salt, nigrosine compounds, dyes made from complexes of aluminum, iron and chromium, or triphenylmethane pigments. The charge control agent can be selected from the ordinary charge control agent. Materials which are difficult to become solved in water are preferred from the viewpoint of controlling ionic strength which affects cohesion and stability during melting, and the viewpoint of less waste water pollution.

The inorganic fine particles may be any of the external additives for toner surfaces generally used, such as silica, alumina, titania, calcium carbonate, magnesium carbonate, tricalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. For example, it is effective to use, in combination, anionic surfactants such as sulfuric acid ester salts, sulfonic acid salts, phosphoric acid esters, soaps, or the like; cationic surfactants such as amine salts, quaternary ammonium salts, or the like; or non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the external additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like. Examples of the organic particles include aliphatic acids, derivatives thereof, and the like, powdered metal salts thereof, and resin powders such as fluorine resin, polyethylene resin, acrylic resin, or the like. The average particle diameter of the powder may be, for example, 0.01 $\mu$m to 5 $\mu$m, and is more preferably 0.1 $\mu$m to 2 $\mu$m.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the cohesive particle dispersion so that the fine particles adhere to the cohesive particles, thus forming adhesion particles, and (iii) heating the adhesion particles which melt to form toner particles.

-Physical Properties for Toner-

It is preferred that the volume average particle diameter of the toner of the present invention is from 0.5 $\mu$m to 10 $\mu$m.

If the volume average particle diameter of the toner is too small, it may have an adverse effect on handling of the toner (supplementation, cleaning properties, fluidability, or the like), and productivity of the particles may deteriorate. On the other hand, if the volume average particle diameter is too large, it may have an adverse effect on image quality and resolution, both of which lead to granulariness and transferring properties.

It is preferred that the toner of the present invention satisfies the above volume average particle diameter range, and that the volume average particle distribution index (GSDv) is 1.3 or less.

It is preferred that the ratio (GSDv/GSDn) of the volume average polymer distribution index (GSDv) and the number average particle distribution index (GSDn) is 0.95 or more.

It is preferred that the toner of the present invention satisfies the volume average particle diameter range, and that the average value of the shape factor expressed by the following equation is 1.00 to 1.50;

$$\text{Shape factor}=(\pi\times L^2)/(4\times S)$$

(Where "L" represents the length of the toner particle and "S" represents the projected area of the toner particle.)

If the toner satisfies the above conditions, it has a desirable effect on image quality, and in particular, on granulariness and resolution. Also, there is less risk of dropout and blur accompanying with toner transferring, and less risk of adverse effect on handling properties, even if the average particle diameter is not small.

The storage elasticity modulus G' (measured at an angular frequency of 10 rad/sec) of the toner itself at 150° C. is 10 Pa to 200 Pa, which is suitable for improving image quality and preventing offset at a fixing step.

<Belt-Fixing Smoothing Device>

The belt-fixing smoothing device comprises a heating and pressuring member, a belt member, a cooling device, a cooling and separating unit, and other members if necessary.

The heating and pressuring member is not particularly limited. Examples thereof include a combination of a heating roller, a pressuring roller, and an endless belt. The cooling device is not particularly limited. Examples thereof include a cooling device which can blow cool air and adjust cooling temperature, a heat sink, and the like.

The cooling and separating unit is not particularly limited, and it may suitably be selected according to the purpose. It typically has a spot near a tension roller where an electrophotographic image-receiving sheet separates from a belt by rigidity (elasticity) of the sheet itself.

When the electrophotographic image-receiving sheet is brought into contact with the heating and pressuring member of the belt fixing and smoothing device, it is preferably pressurized. The sheet can be pressurized by any technique and is preferably pressurized by the application of a nip pressure. The nip pressure is preferably from 1 kgf/cm$^2$ to 100 kgf/cm$^2$ and more preferably form 5 kgf/cm$^2$ to 30 kgf/cm$^2$ for the formation of images with excellent water resistance, high surface smoothness and good gloss. The heating temperature in the hot-pressing member is equal to or higher than the softening point of the thermoplastic resin in the image-forming layer (toner-image-receiving layer), depends on the type of the thermoplastic resin but is generally preferably from 80° C. to 200° C. The cooling temperature in the cooling device is preferably 80° C. or lower and more preferably from 20° C. to 80° C. for the sufficient solidification of the thermoplastic resin layer in the toner-image-receiving layer.

The fixing belt preferably has high smoothness, since the smoothness of the fixing belt significantly affects the smoothness and gloss of the resulting print. The surface roughness of the fixing belt in terms of Rmax is preferably 3 $\mu$m or less, and more preferably 2 $\mu$m or less.

The belt in the belt fixing and smoothing device comprises a heat-resistant support film and a releasing layer arranged on the support film.

The support film is not specifically limited, as long as it has heat resistance, and is, for example, a film of a polyimide (PI), a poly(ethylene naphthalate) (PEN), a poly(ethylene terephthalate) (PET), a poly(ether ether ketone) (PEEK), a poly(ether sulfone) (PES), a poly(ether imide) (PEI), or a poly(parabanic acid) (PPA).

The releasing layer preferably comprises at least one of silicone rubbers, fluorocarbon rubbers, fluorocarbonsiloxane rubbers, silicone resins, and fluorocarbon resins. Of these, it is preferred to dispose a layer of fluorocarbon siloxane rubber on the surface of the fixing belt, or to dispose a layer of silicone rubber on the surface of the belt member, and then to dispose a layer of fluorocarbon siloxane rubber on the surface of the layer of silicone rubber.

Thus, offset or belt stain over the long run operation (of about 100000 sheets printing) can be prevented, and decreased glossiness can be avoided.

It is preferred that the fluorocarbon siloxane rubber has a perfluoroalkyl ether group and/or a perfluoroalkyl group in a main chain thereof.

For the fluorocarbon siloxane rubber, a cured product of fluorocarbon siloxane rubber composition which contains components of (A) to (D) is preferable.

(A) a fluorocarbon polymer having a fluorocarbon siloxane expressed by the following Formula 1 as its main component, and containing aliphatic unsaturated groups, (B) an organopolysiloxane and/or fluorocarbon siloxane containing two or more SiH groups in one molecule, and 1 to 4 times more the molar amount of SiH groups than the amount of aliphatic unsaturated groups in the fluorocarbon siloxane rubber, (C) a filler, and (D) an effective amount of catalyst; and the like.

The fluorocarbon polymer having (A) as a component comprises a fluorocarbon siloxane containing a repeated unit expressed by the following General Formula 1 as its main component, and contains aliphatic unsaturated groups.

General Formula 1

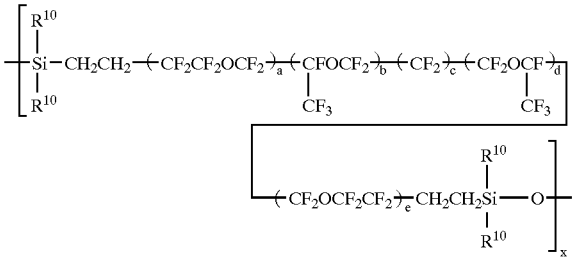

Herein, in the General Formula 1, $R^{10}$ is a non-substituted or substituted monofunctional hydrocarbon group containing 1 to 8 carbon atoms, preferably an alkyl group containing 1 to 8 carbon atoms or an alkenyl group containing 2 to 3 carbon atoms, and particularly preferably a methyl group.

"a" and "e" are, independent of the other, an integer of 0 or 1. "b" and "d" are independently an integer of 1 to 4. "c" is an integer of from 0 to 8. "x" is preferably 1 or greater, and more preferably from 10 to 30.

An example of this component (A) include a substance expressed by the following General Formula 2:

General Formula 2

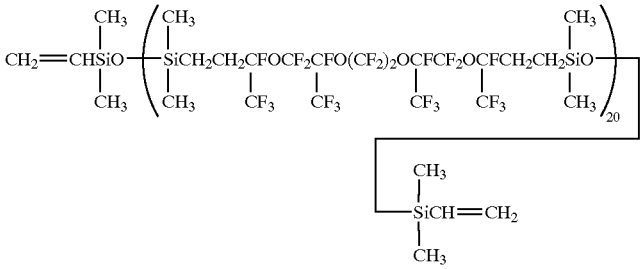

In Component (B), one example of the organopolysiloxane comprising SiH groups is an organohydrogenpolysiloxane having at least two hydrogen atoms bonded to silicon atoms in the molecule.

In the fluorocarbon siloxane rubber composition, when the organocarbon polymer of Component (A) comprises an aliphatic unsaturated group, the organohydrogenpolysiloxane is preferably used as a curing agent. That is, the cured product is formed by an addition reaction between aliphatic unsaturated groups in the fluorocarbon siloxane, and hydrogen atoms bonded to silicon atoms in the organohydrogenpolysiloxane.

Examples of these organohydrogenpolysiloxanes include the various organohydrogenpolysiloxanes used in an addition-curing silicone rubber composition.

It is generally preferred that the organohydrogenpolysiloxane is blended in such a proportion that the number of "SiH groups" therein is at least one, and particularly 1 to 5, relative to one aliphatic unsaturated hydrocarbon group in the fluorocarbon siloxane of Component (A).

It is preferred that in the fluorocarbon containing SiH groups, one unit of the Formula 1 or $R^{10}$ in the Formula 1 is a dialkylhydrogensiloxane group, the terminal group is an SiH group such as a dialkylhydrogensiloxane group, a silyl group, or the like. An example of the fluorocarbon includes those expressed by the following Formula 3.

General Formula 3

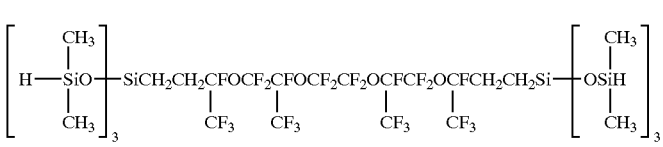

The filler, which is Component (C), may be various fillers used in ordinary silicone rubber compositions. Examples of the filler include reinforcing fillers such as mist silica, precipitated silica, carbon powder, titanium dioxide, aluminum oxide, quartz powder, talc, sericite, bentonite, or the like; fiber fillers such as asbestos, glass fiber, organic fibers or the like.

Examples of the catalyst, which is Component (D), include those any known as an addition reaction catalyst in the art. Specific examples of the catalyst include chloroplatinic acid, alcohol-modified chloroplatinic acid, complexes of chloroplatinic acid and olefins, platinum black or palladium supported on a carrier such as alumina, silica, carbon, or the like, and Group VIII elements of the Periodic Table or compounds thereof such as complexes of rhodium and olefins, chlorotris(triphenylphosphine) rhodium (an Wilkinson catalyst), rhodium (III) acetyl acetonate, or the like. It is preferred to dissolve these complexes in an alcohol solvent, an ether solvent, a hydrocarbon solvent, or the like.

The fluorocarbon siloxane rubber composition is not particularly limited, and it may suitably be selected according to the purpose and may include various additives. For example, dispersing agents such as diphenylsilane diol, low polymer chain end hydroxyl group-blocked dimethylpolysiloxane, hexamethyl disilazane, heat resistance improvers such as ferrous oxide, ferric oxide, cerium oxide, octyl acid iron, or the like; and colorants such as pigments or the like, may be added as a compounding agent, if necessary.

The fixing belt of the present invention is obtained by coating the surface of a heat resistant support film with the fluorocarbon siloxane rubber composition, and heat and cure it. The composition may be diluted to form a coating solution with a solvent such as m-xylene hexafluoride, benzotrifluoride, or the like. The heat curing temperature and time can be suitably selected. The heat curing temperature and time can be suitably selected within the ranges of 100° C. to 500° C. and 5 seconds to 5 hours, according to a type of the support film, a process for manufacturing thereof, or the like.

A thickness of the releasing layer is not particularly limited. The thickness is preferably 1 μm to 200 μm, and more preferably 5 μm to 150 μm, so as to obtain good fixing properties for an image, with preventing toner separation and offset of the toner at the same time.

The belt fixing method may for example be the oilless apparatus for electrophotography as described in JP-A No. 11-352819, or the method where a secondary transfer and fixing are realized simultaneously as described in JP-A Nos. 11-231671 and 05-341666. An apparatus for electrophotography having a fixing belt according to the present invention may be an apparatus for electrophotography including for example at least a heating and pressurizing part which can melt and pressurize the toner, a fixing belt which can transport an image-receiving material with adhering toner while in contact with the toner image-receiving layer, and a cooling part which can cool the heated image-receiving material while it is still adhering to the fixing belt. By using the electrophotographic image-receiving sheet having the toner image-receiving layer in the apparatus for electrophotography which includes the fixing belt, toner adhering to the toner image-receiving layer is fixed in fine detail without spreading onto the image-receiving material, and the molten toner is cooled and solidified, while adhering closely to the fixing belt. In this way, the toner is received onto the electrophotographic image-receiving sheet with completely embedded in the toner image-receiving layer. Therefore, there are no image discrepancies, and a glossy and smooth toner image is obtained.

The electrophotographic image-receiving sheet of the present invention is particularly suitable for forming an image by the oilless belt fixing method, and it permits a large improvement of offset. However, other methods for forming an image may also likewise be used.

For example, by using the electrophotographic image-receiving sheet of the present invention, a full-color image can easily be formed while improving image quality and preventing cracks. A full-color image can be formed using an apparatus for electrophotography capable of forming full-color images. An ordinary apparatus for electrophotography includes an image-receiving paper transporting part, latent image-forming part, and developing part disposed in the vicinity of the latent image-forming part.

To improve image quality, adhesive transfer or heat assistance transfer may be used instead of the electrostatic transfer or bias roller transfer, or in combination therewith. Specific details of these methods are given for example in JP-A Nos. 63-113576 and 05-341666. It is particularly preferred to use an intermediate transfer belt in the heat assistance transfer method. Also, it is preferred to provide a cooling device for the intermediate belt after toner transfer or in the latter half of the toner transfer to the electrophotographic image-receiving sheet. Due to this cooling device, the toner (toner image) is cooled to the softening point of the binder resin or lower, or the glass transition temperature of the toner or less, hence the image is transferred to the electrophotographic image-receiving sheet efficiently and can be separated away from the intermediate transfer belt.

The fixing is an important step that influences the glossiness and the smoothness of the toner image in a final state. The fixing method may be carried out by a heating and pressurizing roller, or belt fixing using a belt, but from the viewpoint of image quality such as gloss and smoothness, belt fixing is preferred. Belt fixing methods known in the art include for example an oil-less belt fixing described in JP-A No. 11-352819, and the method where secondary transfer and fixing are realized simultaneously as described in JP-A Nos. 11-231671 and 05-341666. Further, a primary fixing may also be performed by a heat roller before the heating and pressurizing by the fixing belt and fixing roller.

Figure 4:
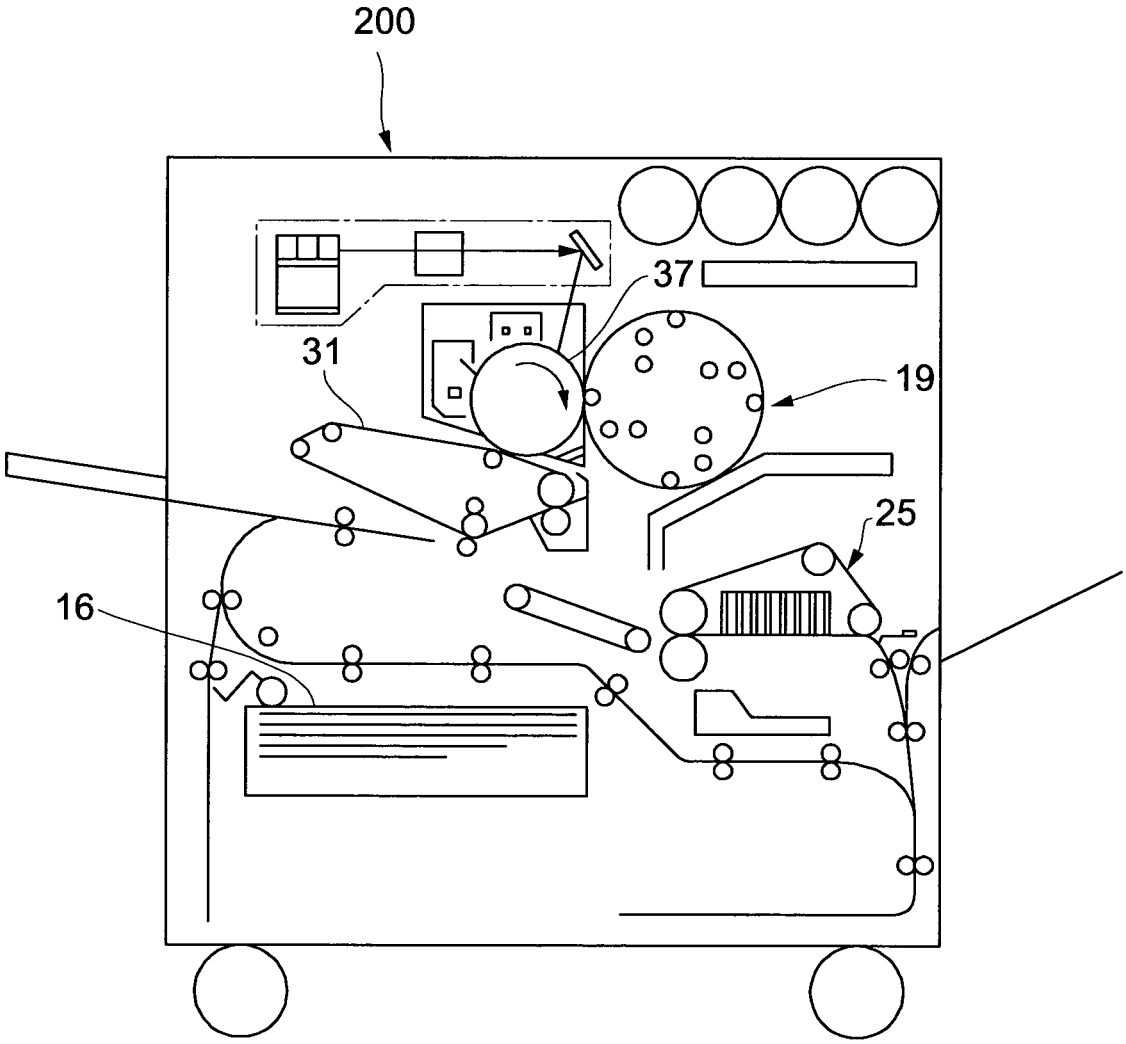
FIG. 4 is a schematic view of an example of an electrophotographic apparatus for use in the present invention.
Figure 5:
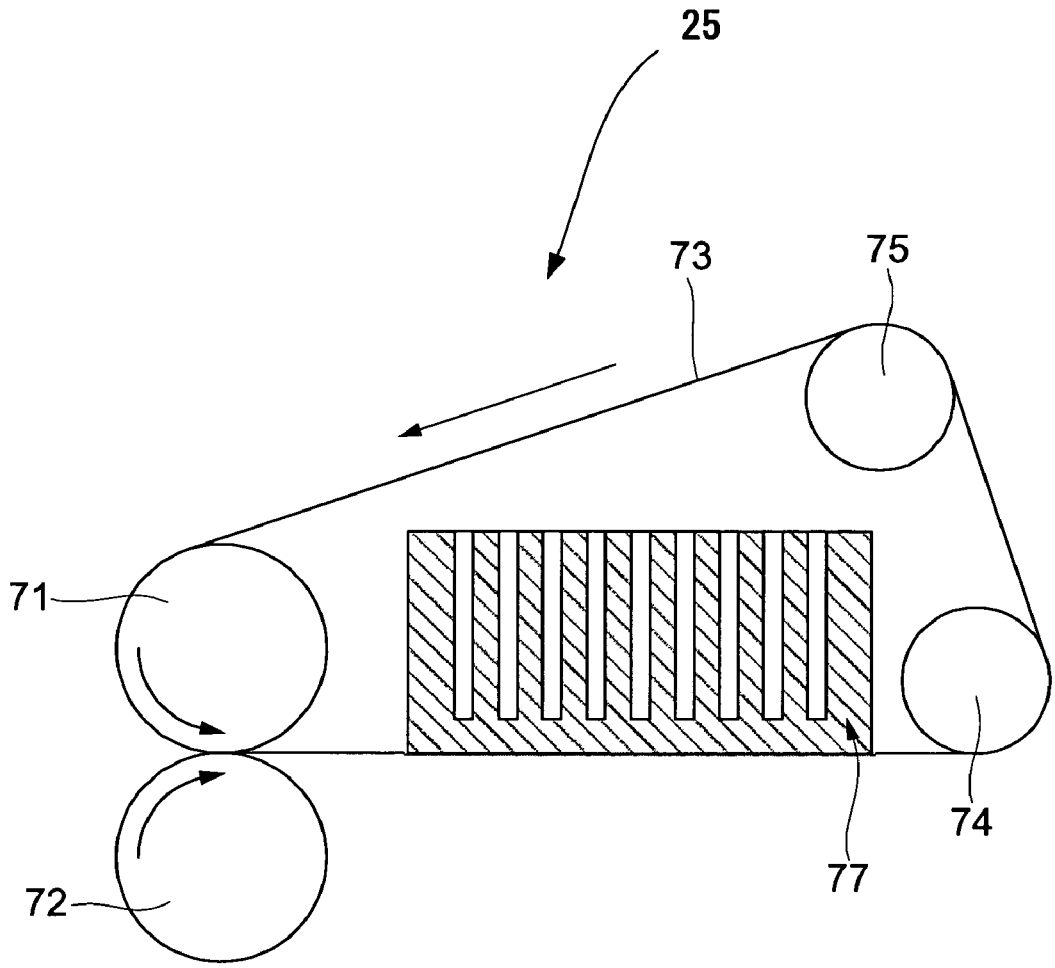
FIG. 5 is a schematic view showing an example of a belt-fixing smoothing device employing cooling separation according to the present invention.

FIG. 5 shows an example of a belt fixing and smoothing device, which can be modified and used as a belt fixing device in the electrophotographic apparatus shown in FIG. 4, such as a full-color laser printer DocuCentre Color 500 (trade name, available from Fuji Xerox Co., Ltd., Japan).

With reference to FIG. 4, the image forming apparatus 200 includes a photoconductive drum 37, a development device 19, an intermediate transfer belt 31, a recording sheet 16, and a belt fixing unit 25.

FIG. 5 shows the belt fixing device 25 arranged inside the image forming apparatus 200 of FIG. 4.

With reference to FIG. 5, the belt fixing unit 25 comprises a heating roller 71, a releasing roller 74, a tension roller 75, an endless belt 73, and a pressuring roller 72 pressed to the heating roller 71 with the interposition of the endless belt 73. The endless belt 73 is rotatably supported by the heating roller 71, the releasing roller 74, and the tension roller 75.

A cooling heatsink 77 is arranged inside the endless belt 73 between the heating roller 71 and the releasing roller 74. The cooling heatsink 77 serves to forcedly cool the endless belt 73 and constitutes a cooling and sheet conveying section for cooling and conveying an electrophotographic image-receiving sheet.

In the belt image-fixing device 25 as shown in FIG. 5, an electrophotographic image-receiving sheet bearing a transferred color toner image on its surface is introduced into a nip so that the color toner image faces the heat roller 71. The nip is a portion at which the heating roller 71 is pressed to the pressure roller 72 with the interposition of the endless belt 73. When the electrophotographic image-receiving sheet passes through the nip between the heating roller 71 and the pressure roller 72, the color toner image T is heated, fused and thereby fixed on the electrophotographic image-receiving sheet.

Specifically, the toner is substantially heated to a temperature of about 120° C. to about 130° C. in the nip between the heating roller 71 and the pressure roller 72 and is thereby fused and fixed to the image-receiving layer of the electrophotographic image-receiving sheet. The electrophotographic image-receiving sheet bearing the color toner image on its image-receiving layer is then conveyed with the endless belt 73 while its surface image-receiving layer is in intimate contact with the surface of the endless belt 73. During conveying, the endless belt 73 is forcedly cooled by the cooling heatsink 77 to thereby cool and solidify the color toner image and the image-receiving layer, and the electrophotographic image-receiving sheet is then separated or released from the endless belt 73 due to its own rigidity by action of the releasing roller 74.

A remained toner and other unnecessary substances on the surface of the endless belt 73 after the completion of the releasing process are removed by a cleaner (not shown) for another image-fixing process.

(Image Forming Apparatus)

Figure 6:
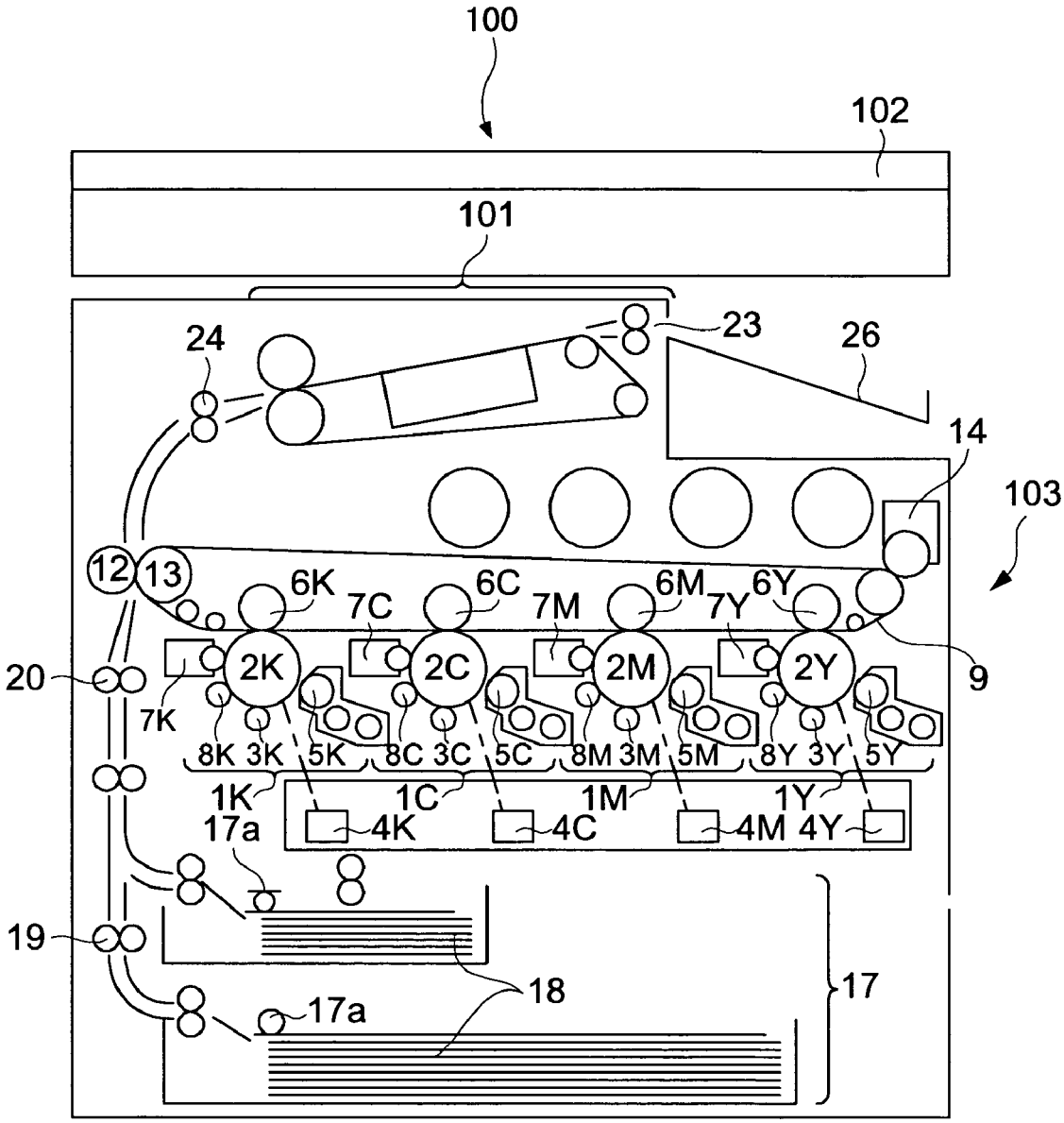
FIG. 6 is a schematic view of an example of an electrophotographic apparatus for use in the present invention.

FIG. 6 is a schematic diagram of a color copying machine (image forming apparatus) constituting the electrophotographic printing system of the present embodiment. The copying machine 100 comprises a main body 103 and an image reader (document read means) 102. The main body 103 houses an image output section (image-forming section) and a image-fixing device 101.

The image forming section comprises an endless intermediate image transfer belt 9 which is spanned over plural tension rollers and is rotated, electrophotographic image forming units 1Y, 1M, 1C, and 1K, a belt cleaner 14 facing the intermediate image transfer belt 9, a secondary image transfer roller 12 facing the intermediate image transfer belt 9, sheet tray 17 for housing sheets of plain paper (image-receiving sheet) 18(S) and sheets of dedicated glossy paper (image-receiving sheet) 18(P), respectively, a pickup roller 17*a,* a pair of conveyer rollers 19 and 24, a pair of resist rollers 20, and a second paper output tray 26. The electrophotographic image forming units 1Y, 1M, 1C, and 1K are arranged from upstream to downstream of a rotation direction of the intermediate image transfer belt 9 and serve to form yellow, magenta, cyan, and black color toner images, respectively.

Each of the electrophotographic image forming units 1Y, 1M, 1C, and 1K comprises, for example, a photoconductive drum (2Y, 2M, 2C, and 2K, respectively), an electrostatic charger roller (3Y, 3M, 3C, and 3K, respectively), a development device (5Y, 5M, 5C, and 5K, respectively), a primary image transfer roller (6Y, 6M, 6C, and 6K, respectively), a drum cleaner (7Y, 7M, 7C, and 7K, respectively), and a charge eliminating roller (8Y, 8M, 8C, and 8K, respectively).

The belt image-fixing device 101 is arranged below the image reader 102 and above the image forming section (e.g., at image transfer position). The image-fixing device 101 is positioned directly above the image forming section (e.g., the intermediate image transfer belt 9) and directly under the image reader 102. The entire conveying path for the image-receiving sheet 18 extending from the second image transfer position to the image-fixing device 101 is positioned directly above the image forming section (e.g., the intermediate image transfer belt 9). A primary image-fixing line connecting between the secondary image transfer position and the primary image transfer position has a substantially normal vertical component. An image-fixing line connecting between the secondary image transfer position and the image-fixing position has a vertical component less than a horizontal component thereof. The image-receiving sheet 18 is ejected from the image-fixing device 101 to an area directly above the image forming section (e.g., the intermediate image transfer belt 9).

The configuration as above can yield the following advantages. Firstly, the entire apparatus 100 occupies as little space (in particular, as little footprint) as possible even though it comprises the image-fixing device 101. Secondly, the electrophotographic image-receiving sheet 18 is ejected at a relatively high position, and the apparatus can be operated easily.

The present invention will now be described with reference to the following Examples. The present invention is not limited thereto, however.

EXAMPLES 1–7 AND COMPARATIVE EXAMPLES 1–3

<Preparation of Electrophotographic Image-receiving Sheet>

-Support-

A smooth base paper having a basis weight of 180 g/m$^2$ was used as Support A.

A support comprised a smooth base paper having a basis weight of 160 g/m$^2$ and a polyethylene resin layer 20 $\mu$m thick formed on both sides of the base paper by lamination was used as Support B.

-Toner Image-Receiving Layer-

A coating liquid for toner image-receiving layer having the following composition was applied to each of the supports shown in Table 1, was dried and thereby yielded six electrophotographic image-receiving sheets P-1, P-2, P-3, P-4, P-5, and P-6 each having a toner image-receiving layer having a thickness shown in Table 1.

[Coating Liquid for Toner Image-Receiving Layer]

A coating liquid for toner image-receiving layer was prepared by mixing 100 parts by mass of a water-dispersed polyester resin, 5 parts by mass of a releasing agent, 7.5 parts by mass of an aqueous dispersion of a white pigment ($TiO_2$), 4 parts by mass of a coating aid, and an appropriate amount of ion-exchanged water. The water-dispersed polyester was Elitel KZA-1449 (trade name, available from Unitica Ltd., Japan) having a solid content of 30% by mass. The releasing agent was carnauba wax Selosol 524 (trade name, available from Chukyo Yushi Co., Ltd., Japan) having a solid content of 30% by mass. The aqueous dispersion of a white pigment was an aqueous dispersion comprising $TiO_2$ TIPAQUE R780-2 (trade name, available from Ishihara Sangyo Kaisha, Ltd., Japan) as the white pigment and a polymer dispersing agent. The coating aid was Alkox E30 (trade name, available from Meisei Chemical Works, Ltd., Japan).

The gloss properties GsP(45°), GsP(*45±3°), and [GsP(45°)/GsP(*45±3°)] of the above-prepared electrophotographic image-receiving sheets before printing were determined. The results are shown in Table 1.

<Gloss Evaluation>

The gloss properties, the specular glossiness GsP(45°) and the scattering index GsP(*45±3°) at a center part of a sample electrophotographic image-receiving sheet were determined according to JIS Z 8741 using a glossmeter UGV-6P (trade name, available from Suga Test Instruments, Ltd., Japan).

Calibration using a standard panel under measurement conditions according to JIS Z 8741 at a measurement aperture of 8 mm diameter, in high sensitivity mode at 45° was performed beforehand, and the specular glossiness GsP(45°) at an acceptance angle of 45° was determined. The scattering index GsP(*45±3°) was then determined by changing the acceptance angle alone to 42° and 48°.

TABLE 1

| Image-receiving sheet | Support | Polyethylene layer | Toner image-receiving layer thickness | Properties of image-receiving sheet before printing: GsP (45°) | GsP (*45° ± 3°) | GsP(45°)/GsP(*45° ± 3°) |
|---|---|---|---|---|---|---|
| P-1 | A | absent | 8 $\mu$m | 20.5 | 18.8 | 1.1 |
| P-2 | A | absent | 12 $\mu$m | 24.0 | 17.3 | 1.4 |
| P-3 | B | present | 4 $\mu$m | 75.6 | 26.0 | 2.9 |
| P-4 | B | present | 8 $\mu$m | 91.3 | 18.6 | 4.9 |
| P-5 | B | present | 12 $\mu$m | 94.0 | 14.2 | 6.6 |
| P-6 | A | absent | absent | 6.5 | 6.3 | 1.0 |

<Electrophotographic Print>

A toner image was electrostatically transferred onto the electrophotographic image-receiving sheet by exposure with light, development, and transfer processes using a modified apparatus. The modified apparatus was the electrophotographic printer DocuCentre Color 500 (trade name, available from Fuji Xerox Co., Ltd., Japan) shown in FIG. 4, except with the image fixing unit shown in FIG. 5 instead of its original image fixing unit (a two-roll fixing device having two heating and pressuring rolls).

The electrophotographic image-receiving sheet was then fed to the image fixing unit shown in FIG. 5 to fix the toner image thereon and thereby yielded a printed image.

<Production of Electrophotographic Prints and Sensory Test>

A uniform black image of 8 bits (0 to 255) in full color R/G/B=0/0/0 was produced using a personal computer and was fed to a printer to yield a series of electrophotographic prints of postcard size (100 mm wide, 148 mm long).

In this procedure, the electrophotographic prints were produced by using fixing belts having different surface roughness Rmax shown in Table 2 and electrophotographic image-receiving sheets shown in Table 1.

Each of the fixing belts used in the printer was prepared in the following manner. A silicone rubber primer DY39–115 (trade name, available from Dow Corning Toray Silicone Co. Ltd., Japan) was applied to a base layer made of a polyimide and was air-dried for 30 minutes. The resulting article was dipped in a coating liquid comprising 100 parts by mass of a silicone rubber precursor DY35-796AB (trade name, available from Dow Corning Toray Silicone Co., Ltd., Japan) and 30 parts by mass of n-hexane to thereby form a coated film, was subjected to primary curing at 120° C. for 10 minutes and thereby yield a silicone rubber layer 40 μm thick thereon.

The silicone rubber layer was then dipped in a coating liquid comprising 100 parts by mass of a fluorocarbon siloxane rubber precursor SIFEL 610 (trade name, available from Shin-Etsu Chemical Co., Ltd., Japan) and 20 parts by mass of a fluorine-containing solvent (a mixture of m-xylene hexafluoride, perfluoroalkanes, and perfluoro(2-butyltetrahydrofuran)) to form a coated film, was subjected to primary curing at 120° C. for 10 minutes and to secondary curing at 180° C. for 4 hours to yield a fluorocarbon siloxane rubber layer 20 mm thick thereon and thereby yielded the fixing belt.

The gloss properties, GsP(45°), GsP(*45±3°), and [GsP(45°)/GsP(*45±3°)] were determined and a sensory test according to the following method was performed on the produced electrophotographic prints. The results are shown in Table 2.

<Sensory Test Score>

The sensory test score is the average of score on a scale of 1 to 5 according to the following criteria by ten subjects.

5: Very desirable
4: Desirable
3: Medium
2: Undesirable
1: Very undesirable

TABLE 2

| | Image-receiving sheet | Fixing method | Belt surface roughness Rmax | Properties of print GsP(45°) | GsP (*45° ± 3°) | GsP(45°/GsP(*45° ± 3°)) | Sensory test score |
|---|---|---|---|---|---|---|---|
| Ex. 1 | P-4 | Belt fixing | 3 μm | 90.3 | 5.4 | 16.7 | 4.5 |
| Ex. 2 | P-4 | Belt fixing | 2 μm | 96.4 | 3.0 | 32.1 | 4.8 |
| Ex. 3 | P-4 | Belt fixing | 1 μm | 97.4 | 2.8 | 34.8 | 4.8 |
| Ex. 4 | P-1 | Belt fixing | 2 μm | 88.0 | 7.5 | 11.7 | 4.3 |
| Ex. 5 | P-2 | Belt fixing | 2 μm | 90.5 | 5.8 | 15.6 | 4.5 |
| Ex. 6 | P-3 | Belt fixing | 2 μm | 86.2 | 12.2 | 7.1 | 4.0 |
| Ex. 7 | P-5 | Belt fixing | 2 μm | 97.8 | 2.9 | 33.7 | 4.8 |
| Comp. Ex 1 | P-4 | Two-roll fixing | — | 86.2 | 17.4 | 5.0 | 3.2 |
| Comp. Ex 2 | P-6 | Belt fixing | 2 μm | 32.0 | 14.2 | 2.3 | 1.8 |
| Comp. Ex 3 | P-6 | Two-roll fixing | — | 10.1 | 9.2 | 1.1 | 1.8 |

The results in Table 2 show that the electrophotographic prints have markedly improved textures in gloss when they have an increased specular glossiness GsP(45°), a decreased scattering index GsP(*45±3°), and a sufficient ratio [GsP(45°)/GsP(*45±3°)].

The results also show that these advantages can be exhibited more by using an electrophotographic image-receiving sheet having a polyethylene resin coated layer formed by lamination on its support, a fixing belt having a surface roughness of a specific level or less, and a toner image-receiving layer having a thickness of a specific level or more.

The present invention can provide an electrophotographic method and apparatus for forming images stably having a good, agreeable, and natural texture in gloss equivalent to conventional silver halide photographic prints.

What is claimed is:

1. An electrophotographic print, wherein a black print image on a toner image-bearing surface of the electrophotographic print has a specular glossiness GsP(45°) and a reflected light scattering index GsP(*45±3°) satisfying the following conditions (I), (II) and (III):

$$30 \leqq GsP(45°) \quad \text{(I):}$$

$$0 \leqq GsP(*45 \pm 3°) \leqq 15 \quad \text{(II):}$$

$$[GsP(45°)/GsP(*45 \pm 3°)] \geqq 6 \quad \text{(III):}$$

wherein GsP(45°) is a specular glossiness at an incident angle of 45° and an acceptance angle of 45°; and GsP(*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

2. An electrophotographic print according to claim 1, wherein the specular glossiness GsP(45°) and the reflected light scattering index GsP(*45±3°) satisfy the following conditions (I'), (II') and (III'):

$$60 \leqq GsP(45°) \quad \text{(I'):}$$

$$0 \leqq GsP(*45 \pm 3°) \leqq 10 \quad \text{(II'):}$$

$$[GsP(45°)/GsP(*45 \pm 3°)] > 8. \quad \text{(III'):}$$

3. An electrophotographic image-receiving sheet comprising:

a support, and at least one toner image-receiving layer on the support, wherein a toner image-forming surface of the electrophotographic image-receiving sheet before printing has a specular glossiness GsP(45°) and a reflected light scattering index GsP(*45±3°) satisfying at least one of the following conditions (IV), (V) and (VI):

$$GsP(45°) < 30 \quad \text{(IV):}$$

$$GsP(*45 \pm 3°) > 15 \quad \text{(V):}$$

$$1 \leqq [GsP(45°)/GsP(*45 \pm 3°)] < 6 \quad \text{(VI):}$$

wherein GsP(45°) is a specular glossiness at an incident angle of 45° and an acceptance angle of 45°; and GsP(*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

4. An electrophotographic image-receiving sheet according to claim 3, wherein the support comprises a base and a thermoplastic resin layer arranged on at least one side of the base.

5. An electrophotographic image-receiving sheet according to claim 4, wherein a thermoplastic resin in the thermoplastic resin layer is a polyolefin resin.

6. An electrophotographic image-receiving sheet according to claim 3, wherein the toner image-receiving layer has a thickness of from 5 μm to 20 μm.

7. An image forming process comprising the steps of:

forming a toner image on an electrophotographic image-receiving sheet having a support and at least one toner image-receiving layer on the support; and fixing and smoothing the toner image on the electrophotographic image-receiving sheet using a belt fixing device to thereby produce an electrophotographic print image, the fixing and smoothing step further comprising:

rotatably supporting a fixing belt of the belt fixing device by plural supporting members including a heating member;

pressing a pressure rotator to the heating member with the interposition of the fixing belt to form a nip;

allowing the electrophotographic image-receiving sheet bearing the toner image to pass through the nip to fix and cool the toner image on the electrophotographic image-receiving sheet; and releasing the electrophotographic image-receiving sheet from the fixing belt, wherein a specular glossiness GsP(45°) and a reflected light scattering index GsP(*45±3°) of a black print image on the toner image-bearing surface of the electrophotographic print satisfy the following conditions (I), (II) and (III):

$$30 \leqq GsP(45°) \quad \text{(I):}$$

$$0 \leqq GsP(*45 \leqq 3°) \leqq 15 \quad \text{(II):}$$

$$[GsP(45°)/GsP(*45\pm3°)] \geqq 6 \quad \text{(III):}$$

wherein GsP(45°) is a specular glossiness at an incident angle of 450 and an acceptance angle of 45°; and GsP (*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

8. An image forming process according to claim 7, wherein the specular glossiness GsP(45°) and the reflected light scattering index GsP(*45±3°) satisfy the following conditions (I'), (II') and (III'):

$$60 \leqq GsP(45°) \quad \text{(I'):}$$

$$0 \leqq GsP(*45\pm3°) \leqq 10 \quad \text{(II'):}$$

$$[GsP(45°)/GsP(*45\pm3°)] \geqq 8. \quad \text{(III'):}$$

9. An image forming process according to claim 7, wherein the support comprises a base and a thermoplastic resin layer arranged on at least one side of the base.

10. An image forming process according to claim 9, wherein a thermoplastic resin in the thermoplastic resin layer is a polyolefin resin.

11. An image forming process according to claim 7, wherein the toner image-receiving layer has a thickness of from 5 μm to 20 μm.

12. An image forming process according to claim 7, wherein the fixing belt comprises a heat-resistant support film and a releasing layer arranged on the support film.

13. An image forming process according to claim 12, wherein the releasing layer comprises at least one selected from a silicone rubber, a fluorocarbon rubber, a fluorocarbonsiloxane rubber, a silicone resin, and a fluorocarbon resin.

14. An image forming process according to claim 13, wherein the releasing layer comprises at least a fluorocarbonsiloxane rubber having at least one of perfluoroalkyl ether groups and perfluoroalkyl groups in its principal chain.

15. An image forming process according to claim 12, wherein the releasing layer has a thickness of from 1 μm to 200 μm.

16. An image forming process according to claim 7, wherein the fixing belt has a surface roughness Rmax of 3 μm or less.

17. An image forming process according to claim 7, wherein a surface of the toner image-receiving layer of the electrophotographic image-receiving sheet before printing has a specular glossiness GsP(45°) and a reflected light scattering index GsP(*45±3°) satisfying at least one of the following conditions (IV), (V) and (VI):

$$GsP(45°) < 30 \quad \text{(IV):}$$

$$GsP(*45\pm3°) > 15 \quad \text{(V):}$$

$$1 \leqq [GsP(45°)/GsP(*45\pm3°)] < 6 \quad \text{(VI):}$$

wherein GsP(45°) and GsP(*45±3°) have the same meanings as defined above.

18. An image forming apparatus comprising:

a toner image forming unit for forming a toner image on an electrophotographic image-receiving sheet having a support and at least one toner image-receiving layer arranged on the support; and a toner image-fixing and smoothing unit comprising:

a heating and pressuring member;

a fixing belt;

a cooling device; and a cooling-releasing section, wherein the image forming apparatus is so configured as to produce an electrophotographic print, wherein a specular glossiness GsP(45°) and a reflected light scattering index GsP(*45±3°) of a black print image on a toner image-bearing surface of the electrophotographic print satisfy the following conditions (I), (II) and (III):

$$30 \leqq GsP(45°) \quad \text{(I):}$$

$$0 \leqq GsP(*45\pm3°) \leqq 15 \quad \text{(II):}$$

$$[GsP(45°)/GsP(*45\pm3°)] \geqq 6 \quad \text{(III):}$$

wherein GsP(45°) is a specular glossiness at an incident angle of 45° and an acceptance angle of 45°; and GsP (*45±3°) is the average of GsP(*42°) and GsP(*48°), wherein GsP(*42°) is a glossiness measured with a specular glossmeter at an incident angle of 45° and an acceptance angle of 42°; and GsP(*48°) is a glossiness measured with a specular glossmeter at an incident angle of 45° and an acceptance angle of 48°.

19. An image forming apparatus according to claim 18, wherein the specular glossiness GsP(45°) and the reflected light scattering index GsP(*45±3°) satisfy the following conditions (I'), (II') and (III'):

$$60 \leqq GsP(45°) \quad (I'):$$

$$0 \leqq GsP(*45 \pm 3°) \leqq 10 \quad (II'):$$

$$[GsP(45°)/GsP(*45 \pm 3°)] \geqq 8. \quad (III'):$$

20. An image forming apparatus according to claim 18, wherein the fixing belt comprises a heat-resistant support film and a releasing layer arranged on the support film.

21. An image forming apparatus according to claim 20, wherein the releasing layer comprises at least one selected from a silicone rubber, a fluorocarbon rubber, a fluorocarbonsiloxane rubber, a silicone resin, and a fluorocarbon resin.

22. An image forming apparatus according to claim 21, wherein the releasing layer comprises at least a fluorocarbonsiloxane rubber having at least one of perfluoroalkyl ether groups and perfluoroalkyl groups in its principal chain.

23. An image forming apparatus according to claim 20, wherein the releasing layer has a thickness of from 1 μm to 200 μm.

24. An image forming apparatus according to claim 18, wherein the fixing belt has a surface roughness Rmax of 3 μm or less.

* * * * *